US008100302B2

(12) United States Patent
Bonner

(10) Patent No.: US 8,100,302 B2
(45) Date of Patent: Jan. 24, 2012

(54) PUMP AND NOZZLE LIQUID FLOW CONTROL SYSTEM

(76) Inventor: Mark Bonner, Frenchtown, NJ (US)

( * ) Notice: Subject to any disclaimer, the term of this patent is extended or adjusted under 35 U.S.C. 154(b) by 824 days.

(21) Appl. No.: 11/222,244

(22) Filed: Sep. 8, 2005

(65) Prior Publication Data

US 2006/0081657 A1 Apr. 20, 2006

Related U.S. Application Data

(60) Provisional application No. 60/607,775, filed on Sep. 8, 2004, provisional application No. 60/672,424, filed on Apr. 19, 2005.

(51) Int. Cl.
*B67D 7/60* (2010.01)

(52) U.S. Cl. ..... 222/401; 222/179; 222/209; 222/212; 222/383.1

(58) Field of Classification Search ..... 222/179, 222/209, 212, 373.1, 383.3, 401, 383.1, 206, 222/207, 463, 465.1, 630–633; 417/199.1, 417/234, 472
See application file for complete search history.

(56) References Cited

U.S. PATENT DOCUMENTS 1,523,688 A * 1/1925 Freeman ..... 222/377
1,558,439 A * 10/1925 Schilplin ..... 222/179
2,772,029 A * 11/1956 De Lucia ..... 222/179
4,592,492 A 6/1986 Tidmore
4,834,269 A 5/1989 Cone
4,880,161 A * 11/1989 Wright ..... 239/330
5,598,955 A 2/1997 Reilley
6,041,977 A * 3/2000 Lisi ..... 222/389
6,412,528 B1 * 7/2002 Alex et al. ..... 141/323
2001/0035208 A1 11/2001 Cromwell et al.
2001/0042573 A1 11/2001 Komaba
2002/0033200 A1 3/2002 Alex et al.
2003/0226615 A1 12/2003 Allen
2004/0129340 A1 7/2004 Zywicki
2004/0194852 A1 10/2004 Few
2004/0250878 A1 12/2004 Watanabe et al.
2005/0051231 A1 3/2005 Harding
2005/0106048 A1 5/2005 Chisholm et al.
2005/0115606 A1 6/2005 Chisholm et al.
2005/0150566 A1 7/2005 Funt et al.

* cited by examiner

*Primary Examiner* — J. Casimer Jacyna
(74) *Attorney, Agent, or Firm* — Norton Rose Or LLP

(57) ABSTRACT

This invention disclosed herein relates to a pump apparatus for use with a liquid container for transferring liquid from a liquid container. It comprises a pump means comprising a manually-operable pump for pumping liquid and formed with a pump chamber through which liquid can be pumped by the pump. It also has an inlet opening for receiving liquid into the pump chamber and an outlet opening for dispensing liquid out of the pump chamber when liquid is pumped through the chamber using the pump. There is a coupling means for mounting the pump means to the opening of a liquid container to permit the gravitational flow of liquid into the pump chamber through the inlet opening when the mounted pump means is placed on ground level and the pump pumped.

9 Claims, 22 Drawing Sheets

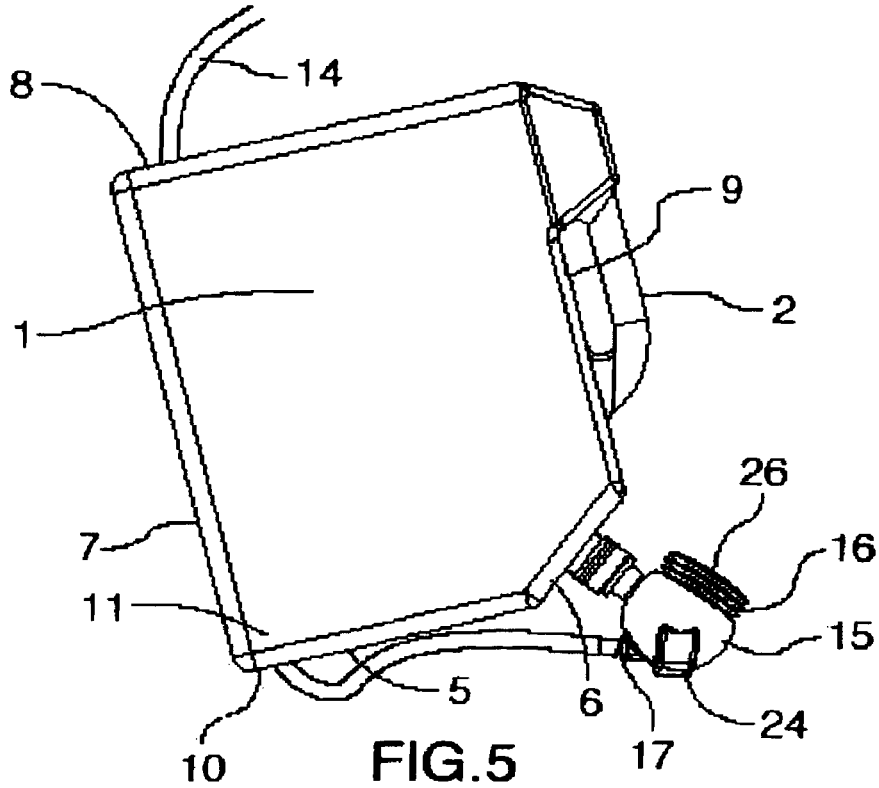
FIG.5
FIG. 6
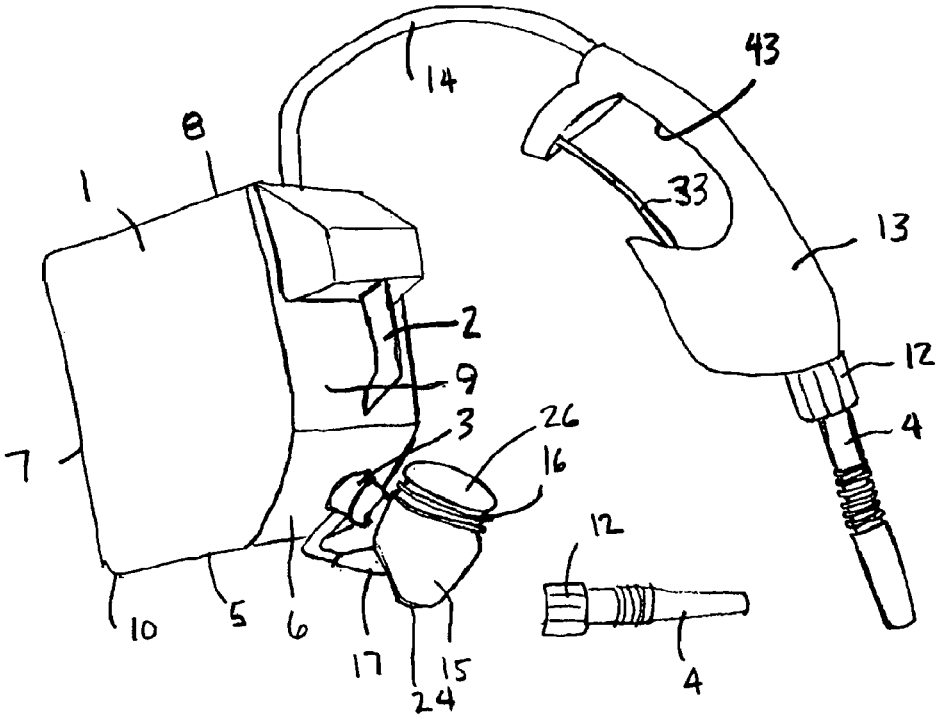

PUMP AND NOZZLE LIQUID FLOW CONTROL SYSTEM

This application claims benefit from U.S. Provisional application 60/607,775 filed Sep. 8, 2004, the entire contents of which are incorporated herein by reference. This application also claims benefit from U.S. Provisional application 60/672,424 filed Apr. 19, 2005 the entire contents of which are incorporated herein by reference.

FIELD OF THE INVENTION

This invention relates to a pump apparatus for use either with or as part of a liquid container so to permit the pumping of the liquid from the container and its delivery into a receptacle which has a limited or small opening to receive the liquid.

This invention also relates to pump apparatus wherein pump apparatus is compatible with the vast majority of current portable gas containers on the market wherein said pump apparatus provides an improved method of transferring liquid gas from a portable gas container into a receptacle.

This invention also relates to an integrated container that has a pump apparatus integrally molded into the container itself, which provides an improved container for transporting and conveying fluid.

The present invention also relates to a system for transferring liquids from a container to a destination, and more particularly to a system for transferring fuel from a container to a destination.

BACKGROUND OF THE INVENTION

Conventional containers for storing fuel and the like have been known for many years. Typically, these fuel containers have a closeable mouth for permitting the ingress of fuel, or whatever liquid, into the container, and for permitting subsequent egress of the fuel, or other liquid, from the container. The mouth is closeable by means of a cap that might be either a one piece cap or a two piece cap. Commonly, two piece caps comprise a collar that is also used to retain the removable and replaceable spout in place on the fuel can for dispensing fuel. In order to pour out the liquid from the container, the cap is merely removed from the mouth, and the container is tilted until the mouth is lower than the level of the liquid. Commonly, an air relief opening having its own selectively removable and replaceable cap permits ready airflow into the interior of the container. New environmental regulations are restricting these containers to only one opening.

Containers for storing liquids for transfer are used in many different applications such as for gasoline or other liquid fuels. The containers are filled up with liquid, such as gas, until they are required for use, at which time the liquid must be transferred. When the transfer for use is required, often a pouring nozzle is attached to the opening and the liquid is poured into a receiving receptacle using a funnel seated at the receptacle opening. Sometimes, due to the urgency or simply the lack of materials on hand, no funnel is available to the user, and the liquid is prone to spillage outside of the receiving receptacle. Even with a funnel, the pouring process can be difficult if the funnel is not properly seated. As well, the container, while filled with fluid, has to be lifted by the person pouring. Pouring liquids from these transfer/storage containers can be both awkward and strenuous.

Several attempts have been made in the past to overcome this awkwardness and strenuousness by introducing devices for or with transfer cans to facilitate the transfer from the container to receptacle using conduit delivery means.

Portable fuel containers have been around for a long time and are necessary for transporting and transferring fuel to numerous vehicles and devices such as lawnmowers, snowmobiles, boats, chainsaws, weed trimmers etc. and transferring the fuel between the portable fuel container and the gas tank of these items is typically done by lifting the container and pouring the fuel into the gas tank.

There have been many attempts at providing an alternate means of transferring fuel from one container to another and it has typically involved a pumping apparatus. Previous solutions and current products on the market have predominantly incorporated a manual pump onto a container so as to be usable in remote areas and these pumps have typically been hand pumps where these pumps move small volumes of liquid, which can be easily managed by the hand or arm. These systems are slow tedious processes because these pumps only move small amounts of fluid with every pump stroke by squeezing or turning of the handle, which in turn requires upper body muscular strength and for the operator to be reasonably physical fit to pump large quantities of liquids. An additional, shortcoming in these type of pumps are that hand pumps are inherently awkward and promote an uncomfortable posture and position when pumping from low-lying containers.

One pumping device is disclosed in U.S. Pat. No. 6,412,528 issued on Jul. 2, 2002 to Alex et al for an invention entitled Siphoning Pump Apparatus. The patent teaches the use of a bellows pump, which is operatively, connected to the portable container with a siphon hose. Upon pumping the liquid can be siphoned from the portable container to the receptacle. This device uses standard siphoning principles for transfer, meaning that the portable container must be elevated above the receptacle for liquid transfer to occur and this relative positioning of the portable container to the receptacle is awkward and not always easily achievable.

Another such device is disclosed in U.S. Pat. No. 4,834,269 issued on May 30, 1989 to Cone for an invention entitled Liquid Container. This invention teaches the forming of a dispensing outlet uniquely located near the base of the container with a dispensing hose mountable to the container at the opening. Liquid is dispensed from the container through the hose by tilting the container. The location of the dispensing outlet permits the achievement of dispensation by only a slight tilting, but this is an extra physical act which also can be awkward for the user.

U.S. Pat. No. 5,598,955, issued Feb. 4, 1997, to Reilley, discloses a Gasoline Dispensing Container with Safety Feature. This container has a main body and a flexible portion having accordion like folds, angled at one side of the main body. When pressure is applied to that portion of the side of the body adjacent the accordion like folds, pressure within the container increases, and liquid is pumped from the container through a flexible hose. This patent teaches a Gasoline Dispensing Container which is laid over on its side and is designed to be stepped or pressed on. The main disadvantage of this dispensing container is the limited amount of pumping pressure that can be generated. Pressure equals force divided by area where in the force in this container is provided by a persons body weight and the area is the cross sectional area of the container. The larger the container the lower the pressure and the lower the pressure the slower the pumping system will become. A Gasoline Dispensing Container such as this produced in the sizes of a typical fuel container would not provide the adequate flow rate to make transferring fuel convenient or useful in this application.

There is a pumping apparatus product currently available on the market, which utilizes a bellows style air foot pump that is sold to be installed on the majority of existing portable fuel container and works by pumping air into the gas container, pressurizing the gas container in order to move the fuel out. The main disadvantage to this design is that portable fuel containers were not designed for this type of pressurization and this product presents the possibility of over pressurizing the fuel container, which may create a potentially explosive situation.

The disadvantages of the prior art discussed above is that they require a particular placement, promote an awkward disposition or are ineffective and difficult to use.

It is an object of at least some embodiments of the present invention provide a pump means for transferring liquid between containers that can be used with or incorporated into a transfer/storage container which is simple and effective to use.

It is another object of at least some of the embodiments of the present invention provide a pump means for transferring liquid between containers that can be used in conjunction with many of the standard liquid storage/transfer containers presently available on the market.

It is another object of at least some embodiments of the present invention to provide a pump means for transferring liquid between containers that can be used without having to dispose the transfer/storage container above the receptacle to achieve transfer.

It is yet another object of the present invention at least some embodiments of the present invention to provide a liquid transfer/storage container with a pump means providing for the easy and effective transfer of liquid therefrom without the user experiencing any awkwardness nor having to dispose the container at a height above the receptacle into which the liquid is being transferred.

It is another object of the present invention of at least some of the embodiments of the present invention to provide a foot pump to take advantage of the operators potential energy (body weight) and make use of the body's strongest mussels (the leg mussels) in order to operated the system.

It is another object of at least some embodiments of the present invention at least some of the embodiments provide a nozzle that allows for a spout to be removed and exchanged with different types of spouts.

It is another object of at least some of the embodiments of the present invention at least some of the embodiments to provide a comfortable safe upright ergonomic pumping position while pumping and operating the system.

It is another object of at least some embodiments of the present invention of at least some of the embodiments to provide a large pump that pumps large volumes of liquid and increases liquid transfer rate with minimal effort.

It is another object of at least some of the embodiments of the present invention at least some of the embodiments to provide a comfortable safe upright ergonomic pumping position while pumping and operating the system.

It is another object of the present invention at least some of the embodiments conform to environmental regulation on portable fuel containers which require the reduction of vapour emissions and spilling during storage and dispensing. By providing a nozzle with an interchangeable spout the present invention can be easily customized and upgraded with various safety spouts in order to meet these present and new standards.

It is another object of at least some of the embodiments of the present invention to provide to provide a liquid dispensing system that does not rely on siphoning.

It is a further object of at least some embodiments of the present invention at least some of the embodiments provide a liquid dispensing system that does not rely on maintaining an increased internal air pressure in order to dispense liquid.

It is an another object of at least some of the embodiments of the present invention provide a liquid dispensing system that can be used to dispense various types of liquids.

SUMMARY

According to an aspect of the present invention, there is provided a pump apparatus for use with a liquid container for transferring liquid from the liquid container, comprising: a pump means comprising a manually-operable pump for pumping liquid and formed with a pump chamber through which liquid is pumped by the pump, there being an inlet opening for receiving liquid into the pump chamber and an outlet opening for dispensing liquid out of the pump chamber when liquid is pumped through the chamber using the pump; a coupling means for mounting the pump means to the opening of a liquid container to permit the gravitational flow of liquid into the pump chamber through the inlet opening when the mounted pump means is placed on a surface and the pump pumped.

According to another aspect of the present invention, there is provided a pump apparatus comprising a pump means and a container for storing and transferring liquid, the pump means comprising a manually-operable pump for pumping liquid and formed with a pump chamber through which liquid is pumped by the pump, there being an inlet opening for receiving liquid into the chamber and an outlet opening for dispensing liquid out of the chamber when liquid is pumped through the chamber using the pump; the container having a dispenser opening for dispensing liquid and a liquid chamber for housing liquid; there being a coupling means for mounting the pump means to the liquid container at the dispenser opening to fluidly connect the pump chamber of the pump means to the liquid chamber of the liquid container to permit the gravitational flow of liquid from the container into the pump through the inlet opening of the pump when the pump means is mounted to the container, placed on a surface and the pump pumped.

According to another aspect of the present invention, there is provided a pump apparatus comprising a pump means and a container formed with the pump means for storing and transferring liquid, the pump means comprising a manually-operable pump for pumping liquid and formed with a pump chamber through which liquid is pumped by the pump, there being an inlet opening for receiving liquid into the pump chamber and an outlet opening for dispensing liquid out of the chamber when liquid is pumped through the pump chamber using the pump; the container having a dispenser opening for dispensing liquid and a liquid chamber for housing liquid; the pump means being integrally mounted to the liquid container at the dispenser opening to fluidly connect the pump chamber of the pump means to the liquid chamber of the liquid container to permit the gravitational flow of liquid from the container into the pump through the inlet opening of the pump when the pump means is mounted to the container, placed on ground level and the pump pumped. Preferably, the pump apparatus is further provided with a liquid flow control nozzle operatively connectible to the pump with a conduit hose mounted to the pump at the outlet opening to receive liquid pumped through the pump chamber by the pump.

In accordance with one aspect of the present invention there is disclosed a liquid dispensing system comprising a liquid container having a top end and a bottom end, and having a first opening for liquids to pass therethrough. The first opening is disposed adjacent the top end of the liquid container. A manually operable pump means is operatively connectable in removable and replaceable relation to the liquid container, so as to be in liquid receiving relation to the first opening of the liquid container. The manually operable pump means is positioned to contact a substantially horizontal supporting surface when the liquid container is rotated about a horizontal axis such that the first opening is adjacent the substantially horizontal supporting surface, to thereby permit the substantially horizontal supporting surface to support the manually operable pump means during pumping. A flexible hose is operatively connected in liquid receiving relation to the pump means.

In accordance with another aspect of the present invention there is disclosed a liquid dispensing system comprising a liquid container having a top end and a bottom end, and having a first opening for liquids to pass therethrough. The first opening is disposed adjacent the bottom end of the container. A manually operable pump means is operatively connectable in removable and replaceable relation to the liquid container, so as to be in liquid receiving relation to the first opening of the liquid container. A flexible hose is operatively connected in liquid receiving relation to the pump means.

In accordance with yet another aspect of the present invention there is disclosed a liquid dispensing system comprising a liquid container having a primary reservoir and a secondary reservoir. A throughpassage interconnects the primary reservoir and the secondary reservoir in fluid communication one with the other. A first opening in the secondary reservoir is for the ingress of liquid into and the egress of liquid from the liquid container. The secondary reservoir includes a manually manipulable flexible portion that acts as a manually operable pump means for causing the egress of liquid from the container through the first opening.

In accordance with yet another aspect of the present invention there is disclosed a dispensing nozzle for use in a liquid dispensing system. The dispensing nozzle comprises a main body having a coupling means for receiving a spout in removable and replaceable relation thereon. A spout is removably mounted on the main body via the coupling means. The spout is operatively connectable in fluid communication to a flexible hose for receiving liquid therefrom.

In accordance with yet another aspect of the present invention there is disclosed a liquid dispensing system comprising a liquid container having a top end and a bottom end, and a first opening for liquids to pass therethrough. A foot operable pump means is operatively connected in liquid receiving relation to the first opening of the liquid container. A flexible hose is operatively connected in liquid receiving relation to the foot operable pump means.

In accordance with yet another aspect of the present invention there is disclosed a pump system for use in dispensing liquid from a liquid container having first opening for liquids to pass therethrough. The pump system comprises a manually operable pump means, and a coupling means for operatively connecting the manually operable pump means in removable and replaceable relation to the liquid container, so as to be in liquid receiving relation to the first opening of the liquid container. There is also an outlet for dispensing liquid pumped by the manually operable pump means Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

It is expressly understood, however, that the drawings are for the purpose of illustration and description only, and are not intended as a definition of the limits of the invention. In the accompanying drawings:

BRIEF DESCRIPTION OF THE DRAWINGS

FIG. 5 is a perspective view of the pump apparatus mounted to a container of FIG. 2 with the pump apparatus being disposed in the pumping position;

FIG. 6 is a perspective view of the pump apparatus and container of FIG. 2 in the pumping position showing a liquid flow control nozzle connected to the pump via a flexible conduit hose;

DETAILED DESCRIPTION INVENTION

Figure 1:
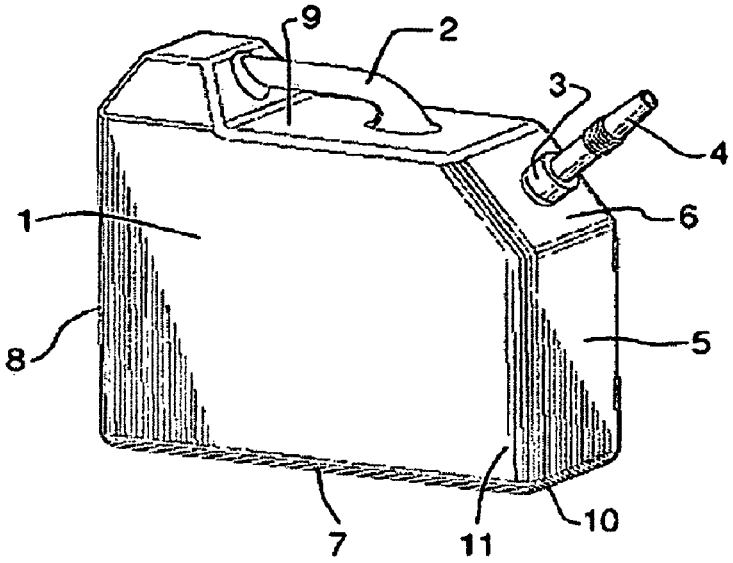
FIG. 1 is a perspective view of a standard liquid container in an upright position ready to be transported or convey a liquid, such as a fuel.

Referring to the drawings, the separate pump apparatus shown in FIGS. 1 to 15 is designed to be compatible with the vast majority of gas containers presently on the market. After the container screw cap 3 and container spout 4 are removed from the container 1, the pump apparatus including the pump 15 is mounted onto to the container 1, utilizing the container's screw cap 3. The fuel conduit hose 14, which communicates with the liquid flow control nozzle 13 is connected to the pump 15 by utilizing a barbed hose end connector 18 at the outlet opening of the pump 15. If required, the container spout 4, previously removed from the container 1, is screwed on to the spout coupler 30 of the liquid flow control nozzle 13. This is shown in FIGS. 1, 2, 3 and 12.

Figure 3:
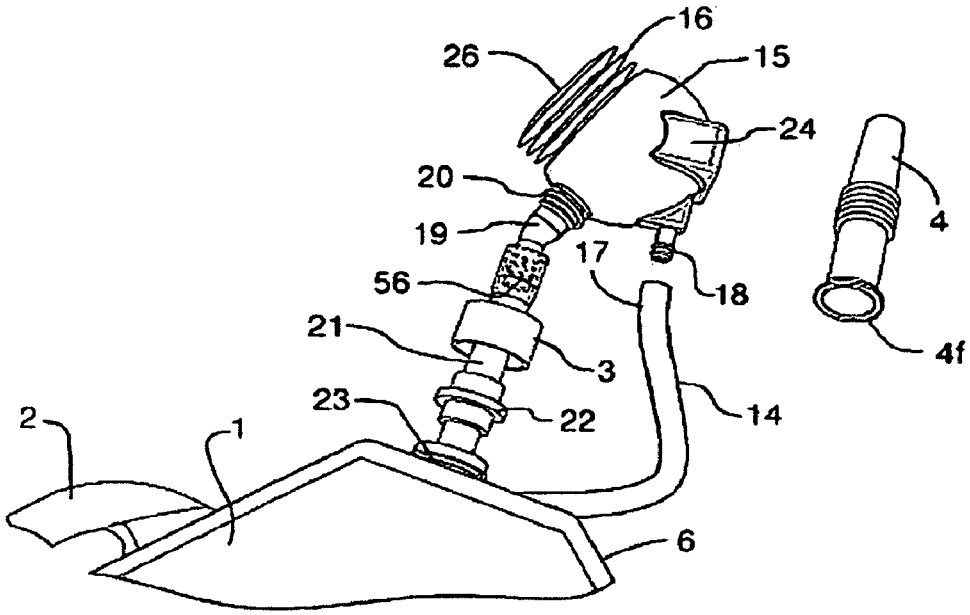
FIG. 3 is a exploded perspective view of the pump apparatus shown in FIG. 2 showing the components used to connect the pump apparatus to a standard gas container.
Figure 4:
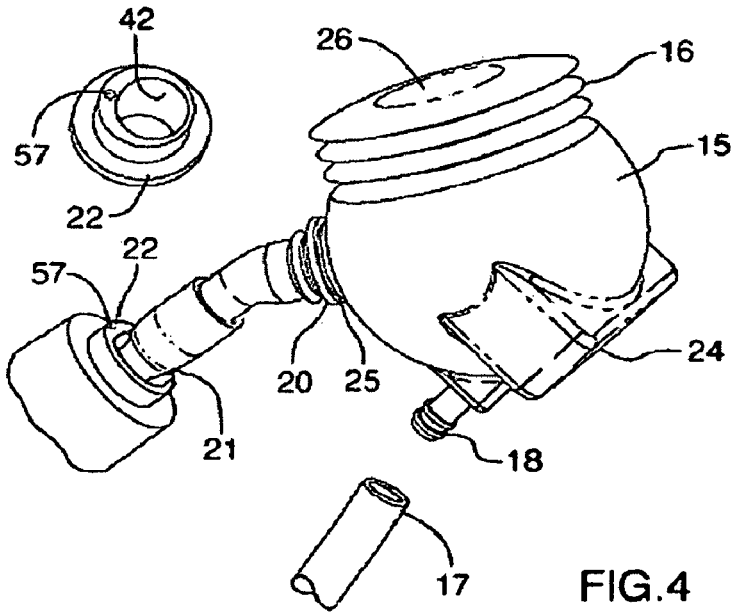
FIG. 4 is a perspective view of the pump apparatus shown in FIG. 2 including an illustration of the coupling ring which is used to enable the pump to be compatible and connect to a standard fuel container.
Figure 7:
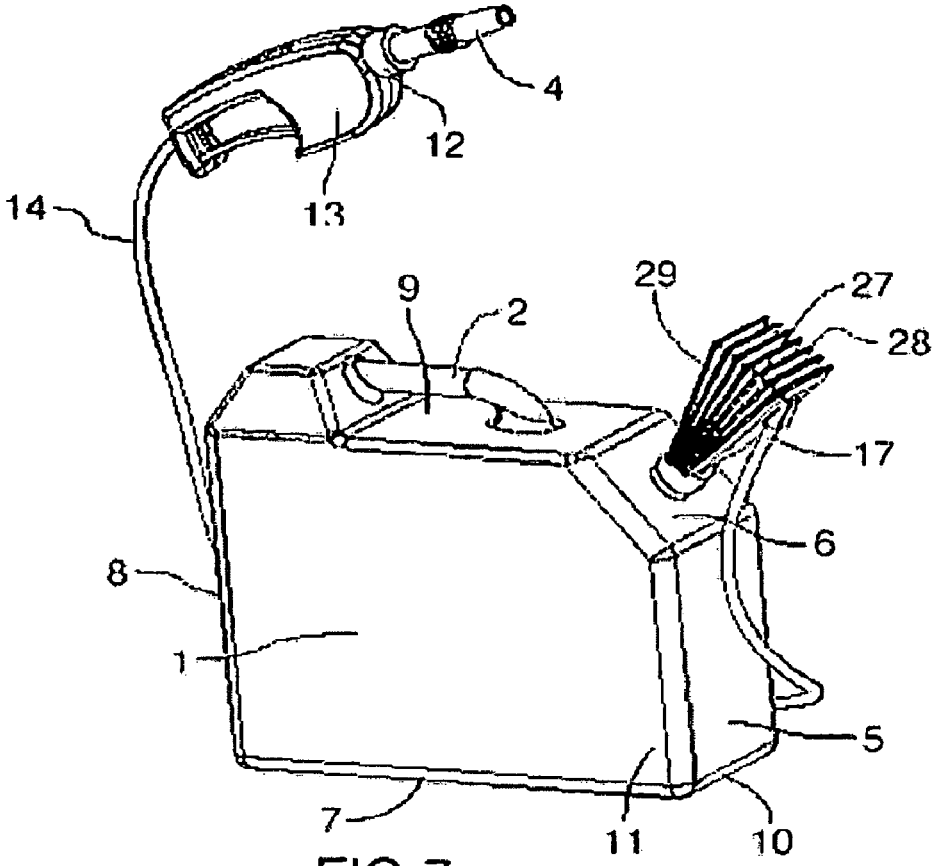
FIG. 7 is a perspective view of another embodiment of the pump apparatus having a rectangular shaped pump with hinged bellows connected to a standard liquid container.
Figure 8:
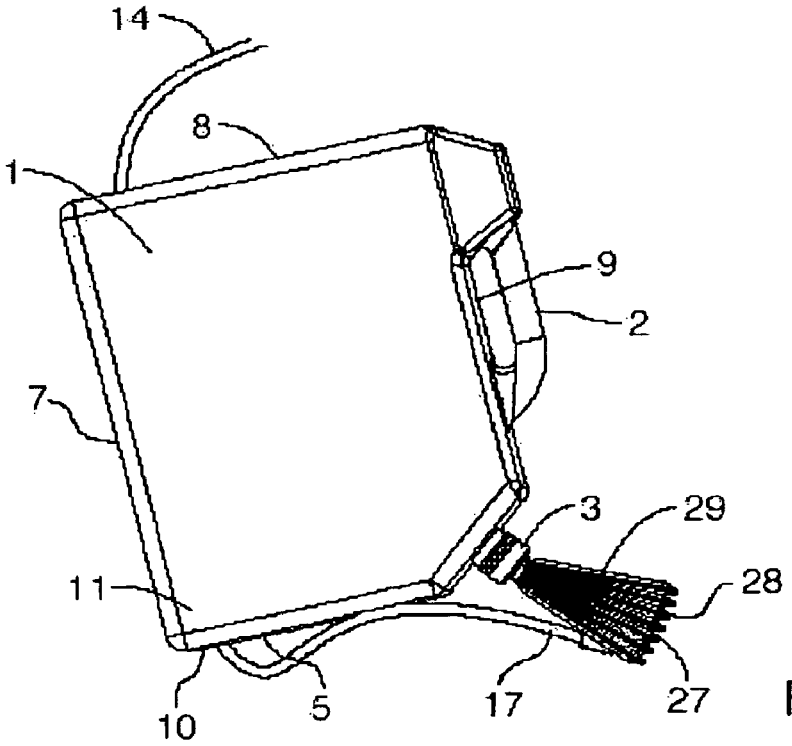
FIG. 8 is a perspective view of the embodiment of FIG. 7 mounted to a standard liquid container and disposed in the pumping position.
Figure 9:
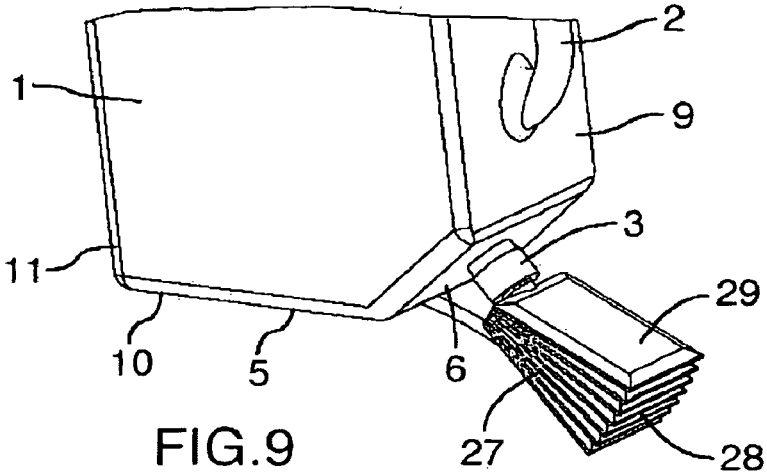
FIG. 9 is a perspective view of the embodiment of FIG. 7 mounted to a standard liquid container and disposed in the pumping position.
Figure 10:
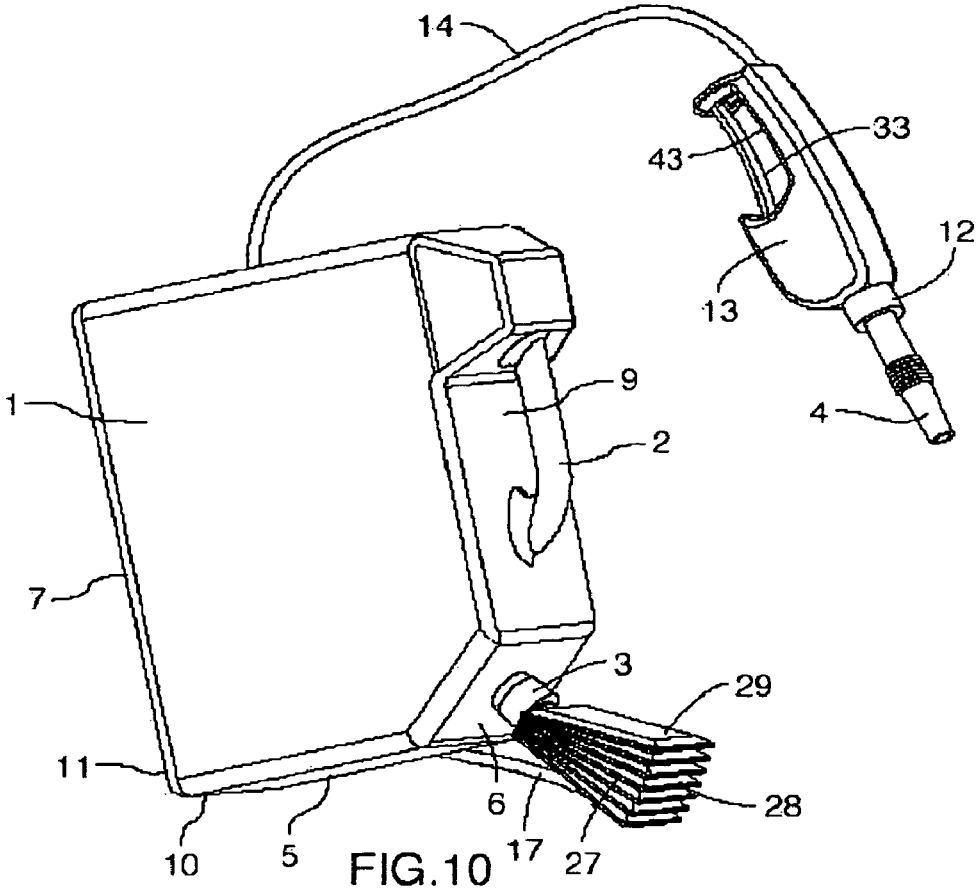
FIG. 10 is a perspective view of the embodiment of FIG. 7 mounted to a standard liquid container and showing a liquid flow control nozzle connected to the pump by a flexible conduit hose.
Figure 11:
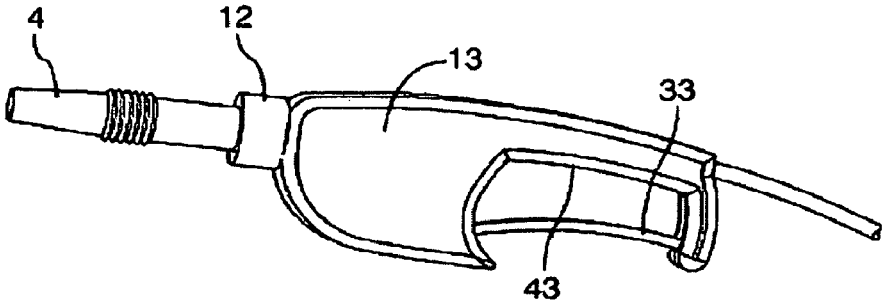
FIG. 11 is a perspective view of an assembled liquid flow control nozzle to be used in association with this invention.

A coupling means attaches the pump apparatus to the container. In the embodiment illustrated, the coupling means includes a universal coupling ring 22 for connecting the pump 15 to the container 1. The universal coupling ring 22 allows the user to connect the pump 15 to a variety of different sized container openings 23, as shown in FIG. 3. The barbed inlet end 19 of the pump 15 is connected to the fuel feed hose 21, which passes through the container screw cap 3, through the universal coupling ring 22 and into the container opening 23, as shown in FIGS. 3 and 4. The universal coupling ring 22 has internal threads 42 which compliment the pump threads 25 for threaded securement, sandwiching the gasket 20 between the coupling ring 22 and the pump 15 to create an airtight seal. The container screw cap 3 is then screwed onto the container threaded outlet 23 tightly securing the coupling ring 22 to in turn secure the pump 15 to the container 1, as shown in FIGS. 1, 3 and 4. The fuel feed hose 21 has two ends. The first end is connected to the barbed inlet member 19 of the pump 15 and the second end is designed to extend downwardly into the container 1 to rest preferably at the lowest position of elevation, at 10, of the container 1 when the container is in the pumping or fuel transferring disposition as shown in FIGS. 5, 6, 8, 9 and 10.

Further to having the pump apparatus formed separately from the container, it can also be incorporated integrally into the structure of a container. As shown in the FIGS. 16, 17, 18 and 19, there is an integrated container-pump consisting of a container 1*i* and pump 15*i* molded as a unit. The integrated container-pump has a container 1*i* that is designed, in this preferred embodiment, to function as a traditional gas container with a container spout 4 attached by a container screw cap 3*i*, or, alternatively the container spout 4 can be removed and replaced by pump core 54, which allows the liquid flow control nozzle 13 to be connected to the pump 15*i* using the fuel conduit hose 14. The original container spout 4, when already removed from the container 1*i*, optionally is screwed on to the spout coupler 30 of the liquid flow control nozzle.

Figure 2:
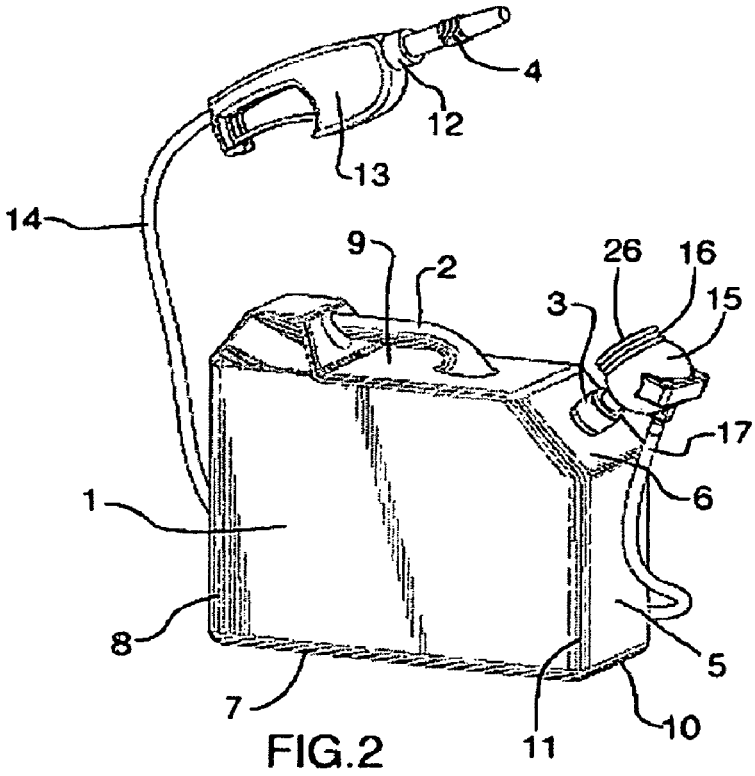
FIG. 2 is a perspective view of an upright standard liquid container with a pump apparatus according to an embodiment of the present invention mounted thereon, including the pump, a flexible hose and a liquid flow control nozzle.
Figure 16:
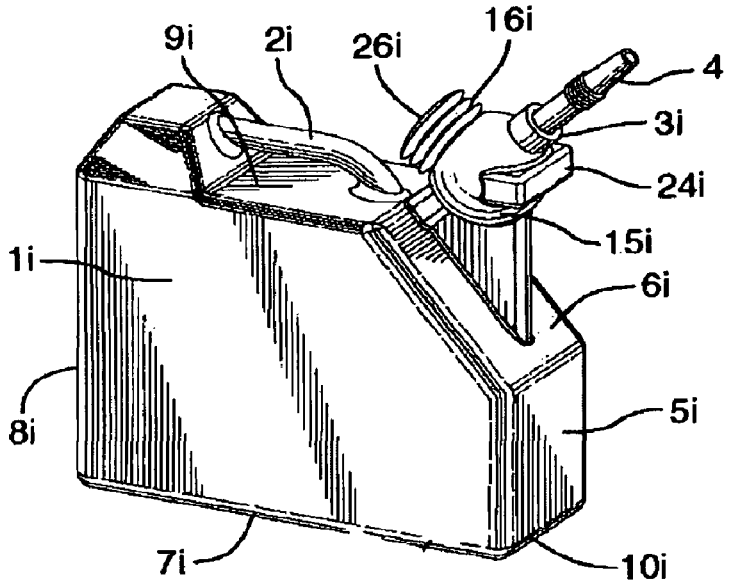
FIG. 16 is a perspective view of another embodiment of the liquid dispensing system according to the present invention, with a conventional container spout in place thereon, ready to pour liquid therefrom.
Figure 22:
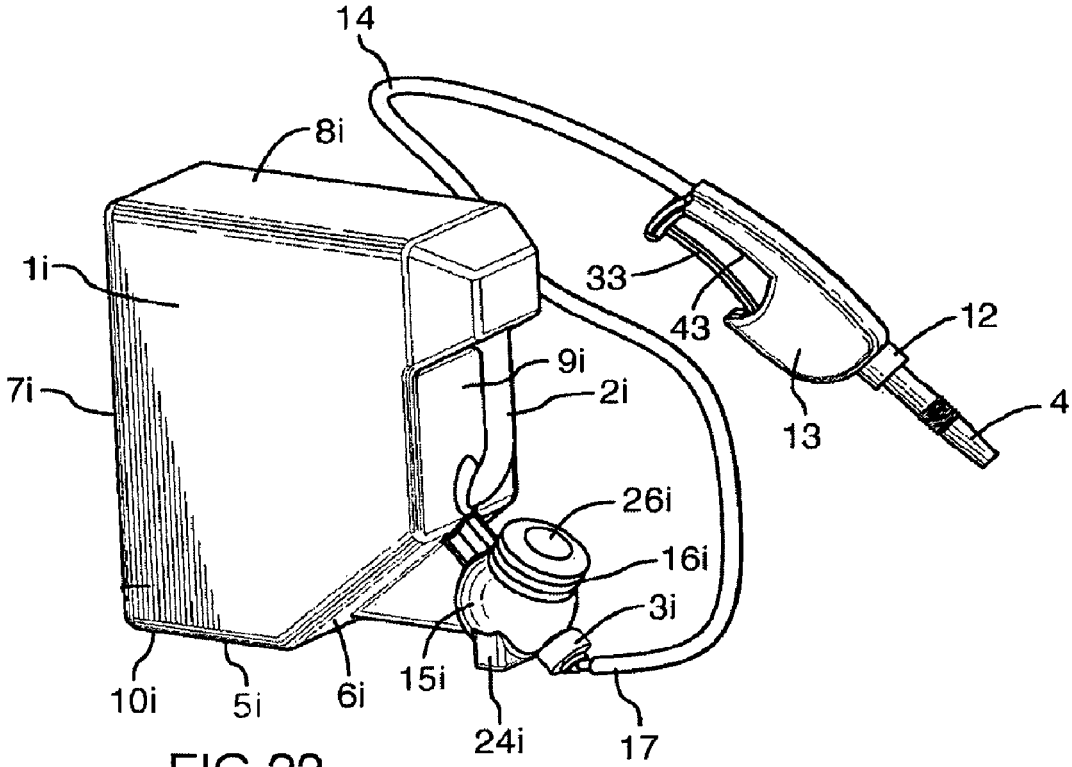
FIG. 22 is a perspective view of a liquid dispensing system of a perspective view of the Integrated Container in the pumping position showing the round bellows style pump, a liquid flow control nozzle connected to the pump via a flexible hose.

The two embodiments as shown in FIGS. 2 and 16 allow a user to pump gas from container 1 or 1*i* into a receiving container in a controlled, convenient, safe and spill-free manner. To dispense the liquid from the chamber of the container 1 or 1*i* respectively, pumps 15 and 15*i* are angled forwardly as shown in FIGS. 5, 6 and 22 until the pump leg 24 and 24*i* seats on the ground or other surface. To commence pumping liquid through the pump chamber of the pump 15 from the chamber of the container 1 through to the nozzle via the fuel conduit hose 14, the operator presses down on pump top, 26 or 26*i* as the case may be, with his foot while simultaneously squeezing the nozzle control arm 33 upwardly toward the upper nozzle body 43. The nozzle control arm 33 in turns allows liquid to flow through the fuel hose pinch portion 35, through the nozzle spout 4 and into a receiving container, an arrangement as shown in FIGS. 6 and 22.

Figure 12:
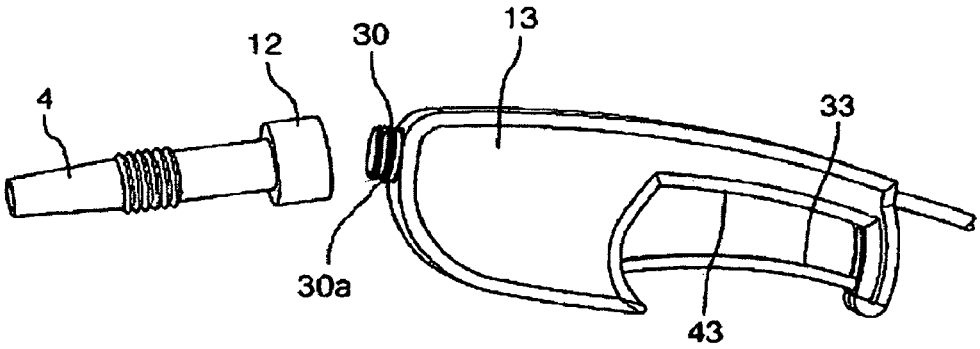
FIG. 12 is a perspective view of the liquid flow control nozzle of FIG. 11 with the detachable spout detached.
Figure 20:
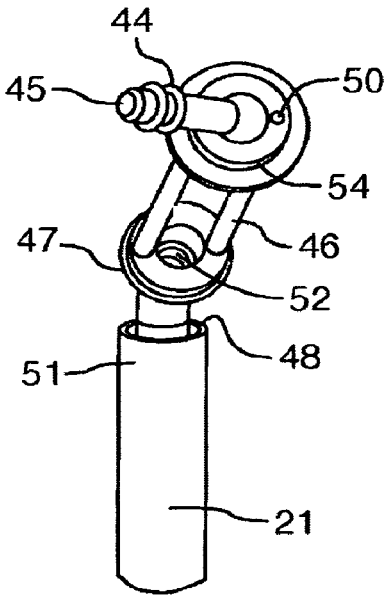
FIG. 20 is an enlarged perspective view of the pump core shown in FIG. 18.

The embodiments shown in FIGS. 2 and 16 advantageously include three check valves. The first check valve is an air check valve, 57 in FIGS. 4 and 53 in FIG. 21, the second check valve in the pumping check valve 56 in FIGS. 3 and 52 in FIG. 20; and the third check valve is, in the one arrangement, incorporated in the spout coupler 30 of the liquid flow control nozzle 13 as shown in FIG. 12.

The universal coupling ring 22 of the pump 15 has incorporated within its structure an air check valve 57, thereby, in use, only allowing air to flow into the container 1. This, during operation of the pump, permits the pressure within the container 1 to equalize.

The pumping check valve 56, if formed on the pump 15, can advantageously be positioned at either end of the fuel hose 21 or in the opening of the barbed inlet member 19. The pumping check valve 56 regulates the fluid flow so that liquid only flows in one direction, namely from the chamber of the container 1 into the pump chamber of the pump 15. When the pump top 26 is foot pumped by the user, the pumping check valve 56 closes to prevent liquid in pump 15 from backflowing to the chamber of the container 1. The force of stepping on the pump top 26, during use, forces the liquid into the nozzle hose 14 and through the liquid flow control nozzle 13. When pumping pressure on the pump top 26 is stopped (i.e. the operator's foot is removed) the pump bellows 16 in the embodiment illustrated resultingly expands to draw in more liquid. As the pump bellows 16 expand to draw in more liquid, the third check valve within the spout coupler 30 closes to prevent the liquid from being sucked out of the liquid flow control nozzle 13. The closure of the check valve in the spout coupler 30 assures that the pumping check valve 56 opens to permit liquid to flow from the chamber of the container 1 into the chamber of the pump 15.

The pump core 54 of the container 1*i* of the integrated container-pump is formed with an air intake 50, an air way tube 46, an air check valve 53 and a pumping check valve 52 where the function of these features are equivalent to the valves incorporated into the embodiment where the pump assembly is formed separately from the container. The pump core 54 is located inside the integrated pump 15*i*. As the operator applies pumping pressure downwardly on the integrated pump top 26*i*, pumping check valve 52 closes and the liquid in the pump 15*i* is forced into the nozzle hose 14 through to the liquid flow control nozzle 13. Contemporaneously, air is drawn into the integrated container 1*i* via the air intake 50, through air tube 46, past air check valve 53 and into the container 1*i*. The air way tube 46 allows air to bypass the pump 15*i* and the check valve 53 prevents liquid residing in the chamber of the container 1*i* from flowing out through the air way tube 46. As the operator releases pressure on the integrated pump top 26*i*, by releasing his foot, the check valve of the spout coupler 30 resultingly closes and the pumping check valve 52 resulting opens to permit liquid to flow from the chamber of the container 1*i* into the chamber of the integrated pump 15*i*. This is better understood by reference to FIGS. 17, 18, 19 and 20.

Seal 47 of the pump core 54 seals the pump chamber of the pump 15*i* from the chamber of the container 1*i*.

The embodiments of the pump apparatus, whether it be a separate from the container or integrally formed with the container, are advantageously used with a nozzle hose, preferably comprised of a flexible plastic material resistant to corrosive liquids or chemicals, for receiving liquid from the pump and delivering the liquid to the nozzle. Reference in respect of the nozzle hose to FIGS. 2, 3, 4, 5, 6, 7, 8, 10, 13, 14, 15, 16, 17 and 18.

As well, both the separately formed and the integrally formed container-pump configurations have a container fuel hose 21, also preferably made from a corrosive-resistant flexible or a hard plastic material) which, during operation of the pump apparatus, draws liquid from the lowest elevation 10 and 10*i* of the chamber of the container 1, 1*i*. In this regard, reference is made to FIGS. 3, 4 and 6.

The liquid flow control nozzle assembly permits the operator to connect different container spouts 4 to the liquid flow control nozzle 13 using the nozzle screw cap 12. It will be apparent that there are many different liquid container manufacturers and each manufacturer often provides their own uniquely designed spout with the liquid container. The liquid flow control nozzle taught herein is designed to be compatible to the vast majority of container spouts and each respective spout can be connected to the liquid flow control nozzle 13 using the nozzle screw cap 12 and threaded nozzle outlet end 30 design. In this regard, reference is made to FIGS. 11 and 12.

FIGS. 12A to 12F are of special importance from an environmental viewpoint because they show the incorporation of an auto closure spout 58, a safety feature that prevents spilling by automatically sealing the end of the spout when the auto closure spout 58 is drawn from the tank.

Figure 12A:
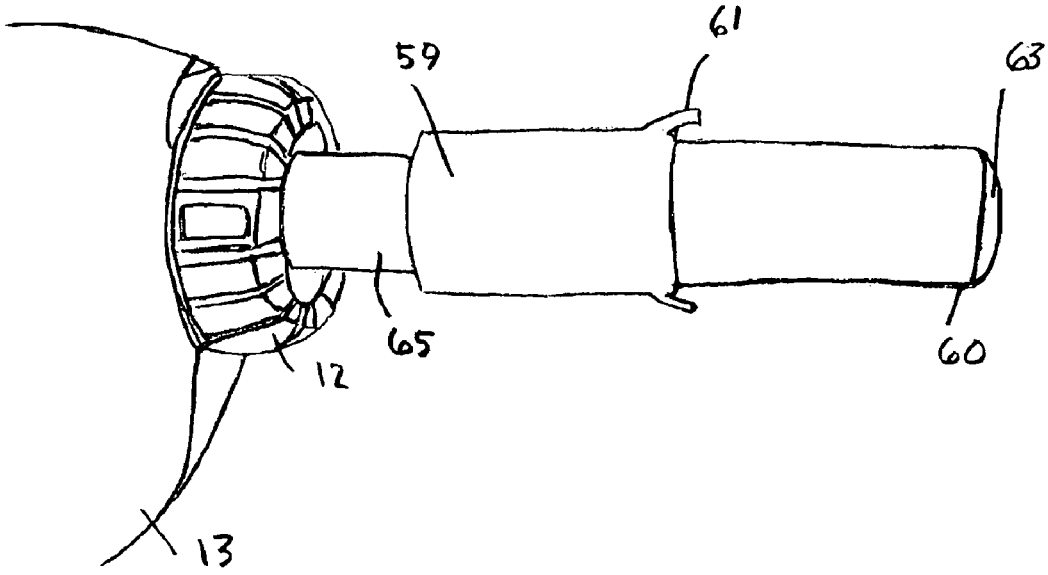
FIG. 12A is a perspective view of the liquid flow control nozzle modified to include an auto closure spout, shown therein in the closed position.
Figure 12B:
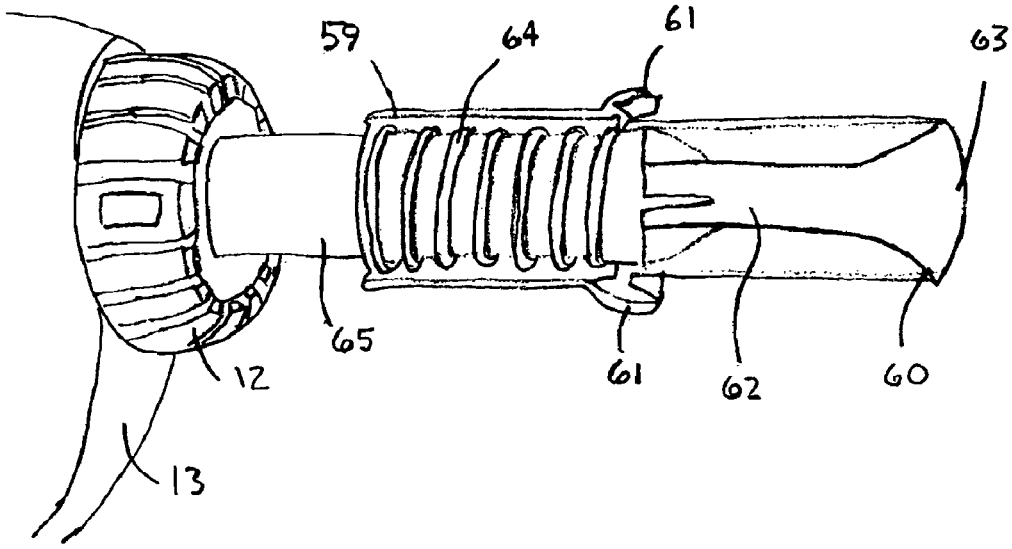
FIG. 12B is a perspective view of the liquid flow control nozzle with the auto closure spout as in 12A sectioned to show components and structure in the closed position.
Figure 12C:
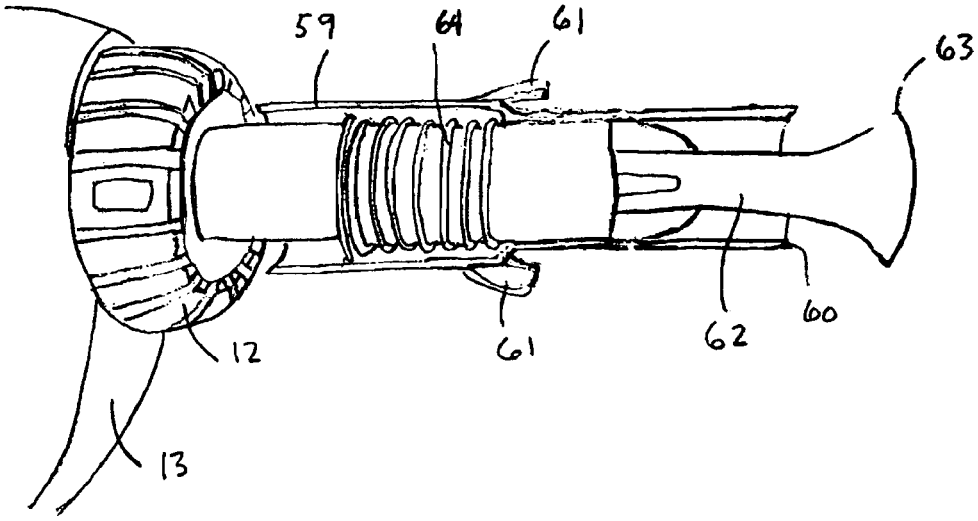
FIG. 12C is a perspective view of the liquid flow control nozzle with the auto closure spout of FIGS. 12A and 12B sectioned to show components and structure in the open position.
Figure 12D:
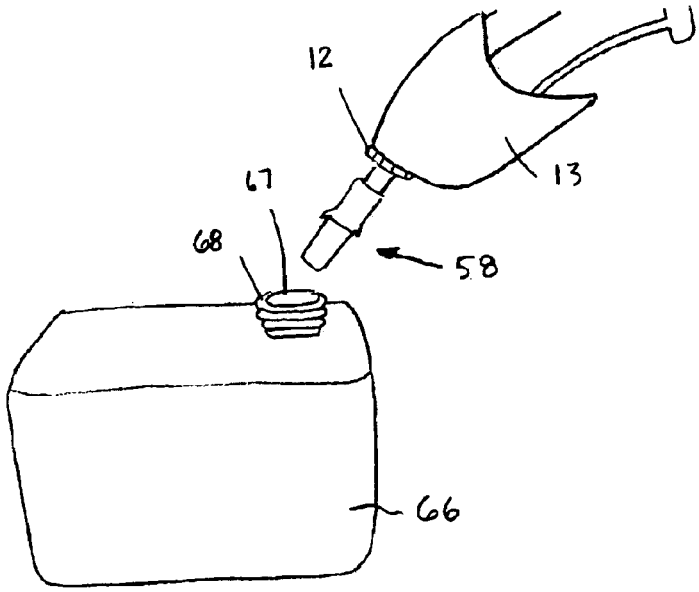
FIG. 12D is a perspective view of the liquid flow control nozzle with the auto closure spout in the closed position before insertion into the opening of the liquid container for dispensing.
Figure 12E:
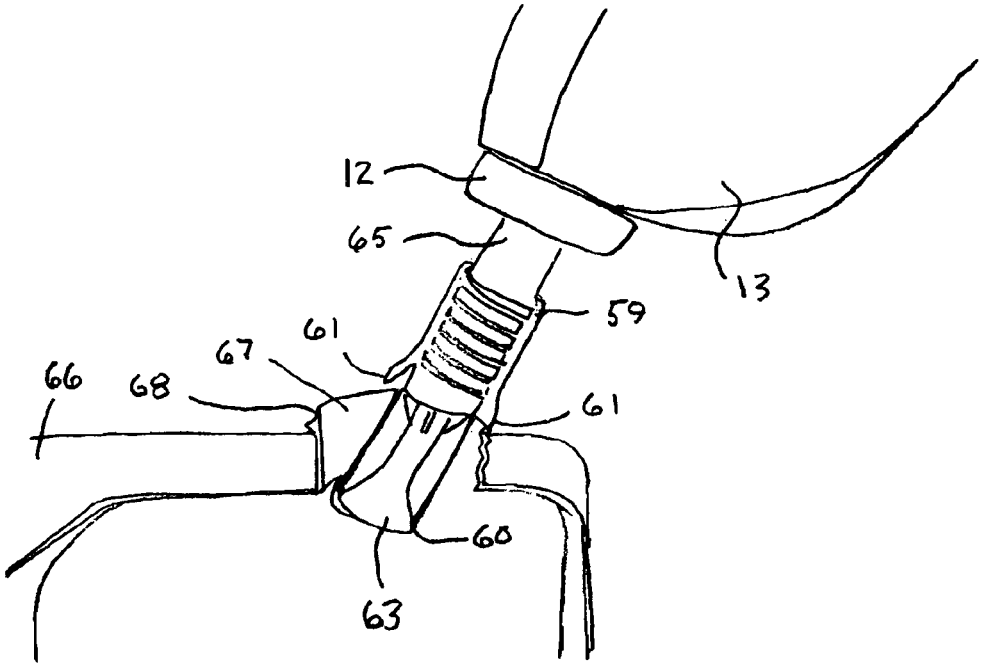
FIG. 12E is a perspective sectioned view of the liquid flow control nozzle, auto closure spout and container, showing the spout, while still in the closed position, being inserted and mounted for opening on the container opening rim.
Figure 12F:
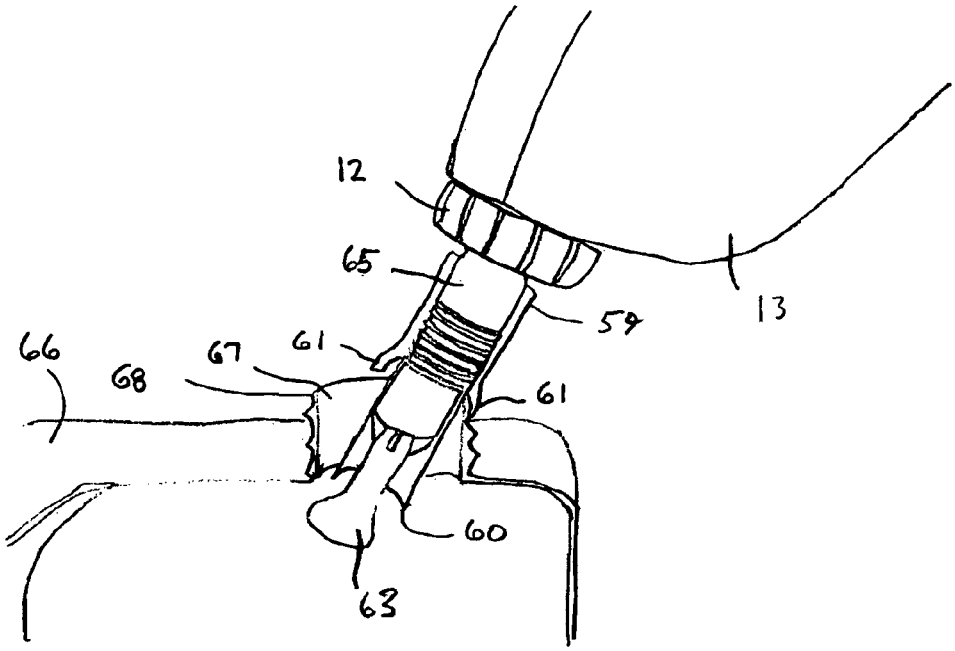
FIG. 12F is a perspective sectioned view similar to FIG. 12E except that the auto closure spout is shown pressed into the open position to permit dispensing of liquid.

As shown in FIGS. 12D, 12E and 12F, to dispense liquid, the auto closure spout 58 must be placed inside the container opening so that the sleeve hook 61 is hooked on to the rim 68. Once in place, as shown in FIG. 12E, the nozzle 13 is pushed downwardly so that the sprue sealing end continues to move forwardly, compressing the locating spring 64 while the sliding sleeve remains seated on the rim 68. Thus, the spout is opened, allowing liquid flow. After fueling, the withdrawal of the nozzle 13 permits locating spring 64 to reassert itself to return the sliding sleeve 59 to the closed position. Spillage and unwanted dripping are prevented by bringing the sleeve sealing end 60 into contact with the sprue sealing end 63.

As well, both the separately-formed and integrated container-pump embodiments of this invention provide for different design styles and shapes of the pump 15. Pump 27, for instance, is rectangular and has a hinged bellows design. In this regard, reference in FIGS. 7, 8, 9 and 10.

The liquid flow control nozzle 13, as taught herein, is a simple means of regulating the flow, incorporating a principle of operation that involves pinching the nozzle hose 14. In this regard, reference is made to FIGS. 13, 14 and 15. It will be apparent that other means of regulating the flow can be used, such as, for instance, mechanical valves. However, the pinching is thought to be, by the inventors superior, because resistance is minimized and flow rate maximized by its incorporation. In the embodiments of the nozzle delivery systems illustrated, there is an un-pinching and a pinching of the nozzle hose 14 to start and stop liquid flow. In this regard, reference is made to FIGS. 13 and 14. An angled pinch head 34 is used to effect the pinching and unpinching, by unsqueezing or squeezing the nozzle control arm 33 and upper nozzle body 43 in respect to each other to effect release of pressure or application of pressure on fuel hose pinch spot portions 36 and 37. In this regard, reference is made to FIG. 15.

The invention as described above works well because it provides a pump mechanism that can be incorporated into a standard type container, either as an add-on or by integrated molding, and which utilizes gravity assisted feed. This is unlike other products which have to pull liquid from the container into the pump before it can be pushed to the nozzle. The gravity assistance helps fill the pump, speeding up the process and eliminating any requirement for an internal return spring to re-expand the pump after it is depressed during the pumping operation. The relative disposition of the pump and the container, when it is laid in dispensing disposition, places the pump at ground level so that the liquid in the chamber of the container is above the pump and a head pressure permitting the liquid to flow into the pump without energy having to be added to the system.

The system resulting from the employment of this invention is advantageous because there is no increasing pressurization of the container. This overcomes many of the problems with systems of the prior art which require pressurization of the chamber of the container to force the fluid through the hose and nozzle. Positive pressurization is to be avoided because it creates a danger of explosion.

As well, the invention described advantageously and preferably employs a foot-operated pump utilizing the operator's strongest muscles employed in an easy manner.

The invention is also novel in respect of providing a bellow foot pump for the transfer of liquid from a container.

As a further benefit, the invention works well and effectively when an auto closure spout is used on the end of the nozzle for dispensing liquid to ensure compliance with environmental concerns.

The invention as described in simple, reliable, easy to produce, use and maintain. Several advantages over the prior art further to those explicitedly described will be apparent to those skilled in the art. The embodiments illustrated are preferred embodiments only and the specification is not meant to be read in a limiting manner. The scope of the invention is as claimed in the appended claims.

Figure 13:
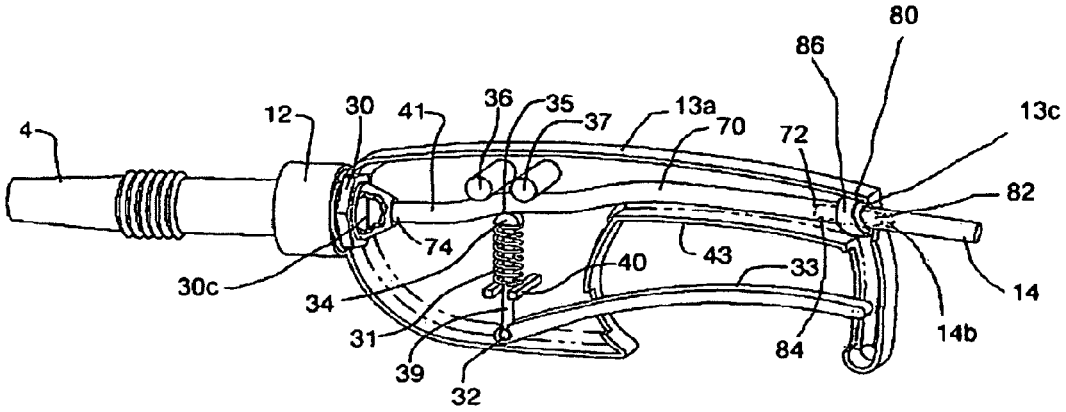
FIG. 13 is a sectioned view of the liquid flow control nozzle of FIG. 11 showing the internal components.
Figure 14:
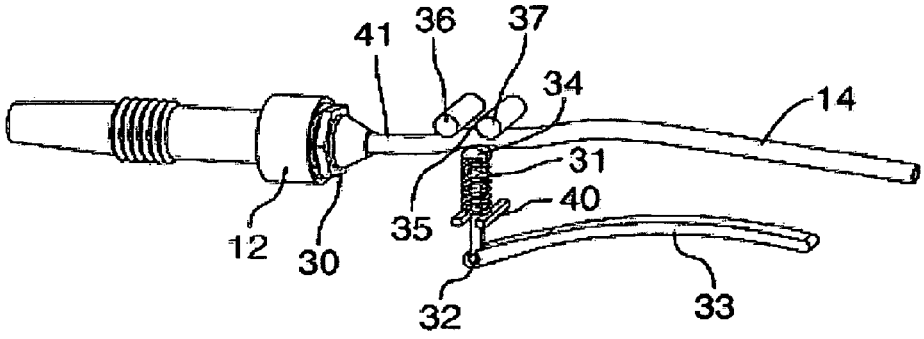
FIG. 14 is a perspective view of the internal components of the liquid flow control nozzle of FIG. 11 in the on position.
Figure 15:
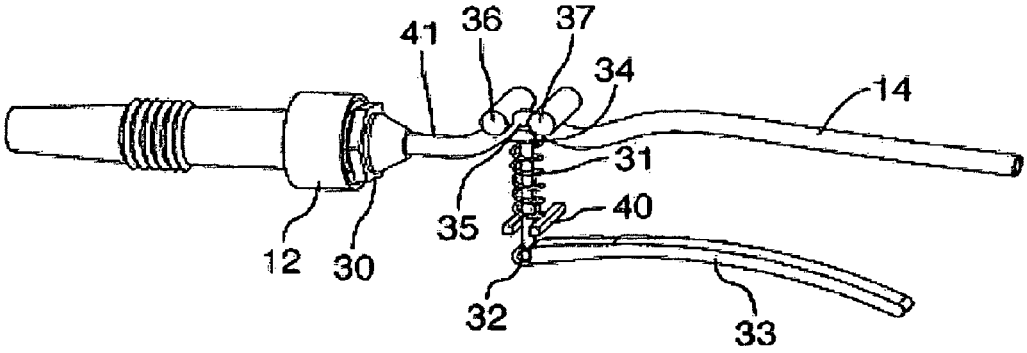
FIG. 15 is a perspective view of the internal components of the liquid flow control nozzle of FIG. 11 in the off position, pinching the flexible conduit hose.
Figure 15A:
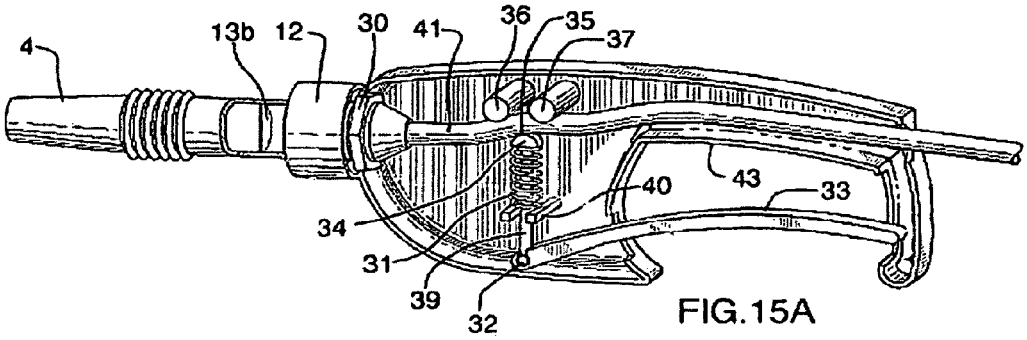
FIG. 15A is a side elevational view of a dispensing nozzle used in the liquid dispensing system of the present invention, specifically showing a check valve in the spout.
Figure 21:
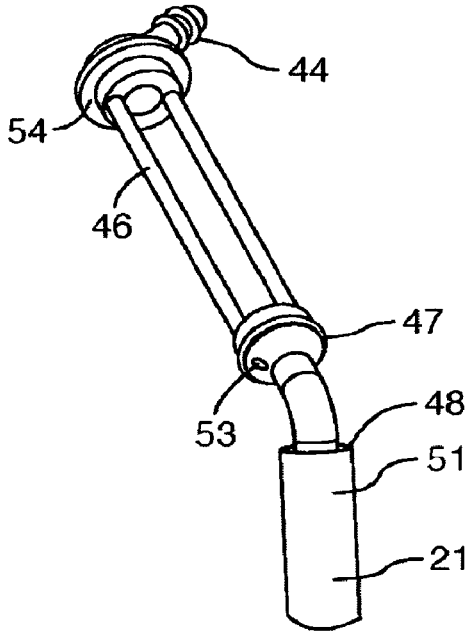
FIG. 21 is a perspective view from the opposite end of the pump core of FIG. 20.
Figure 21A:
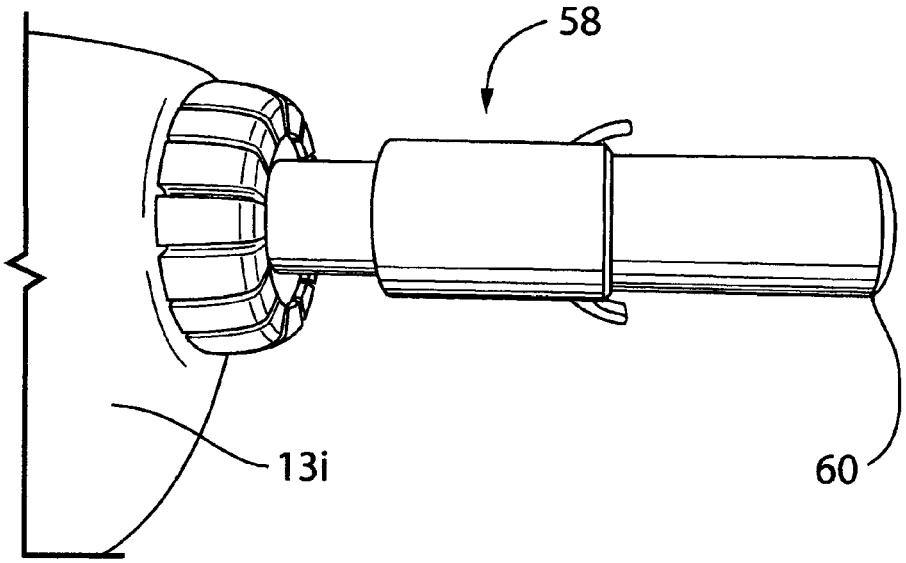
FIG. 21A is a side elevational view of an alternative preferred embodiment of the dispensing nozzle, specifically showing an auto-closure nozzle.
Figure 21B:
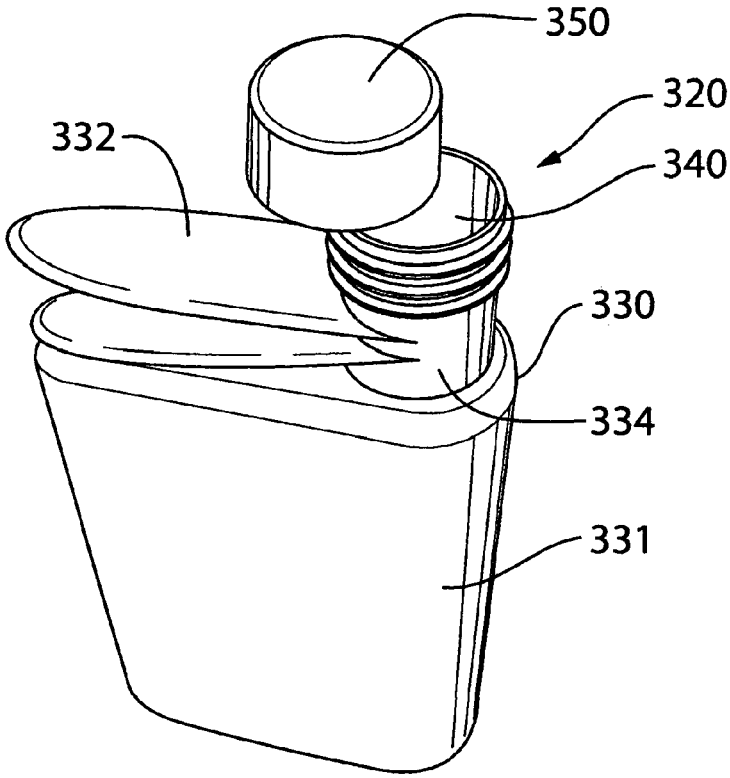
FIG. 21B is a perspective view of another embodiment of the liquid dispensing system according to the present invention; and, FIG. 21C is a perspective view of an alternative embodiment of the pump used in liquid dispensing system of the present invention.
Figure 21C:
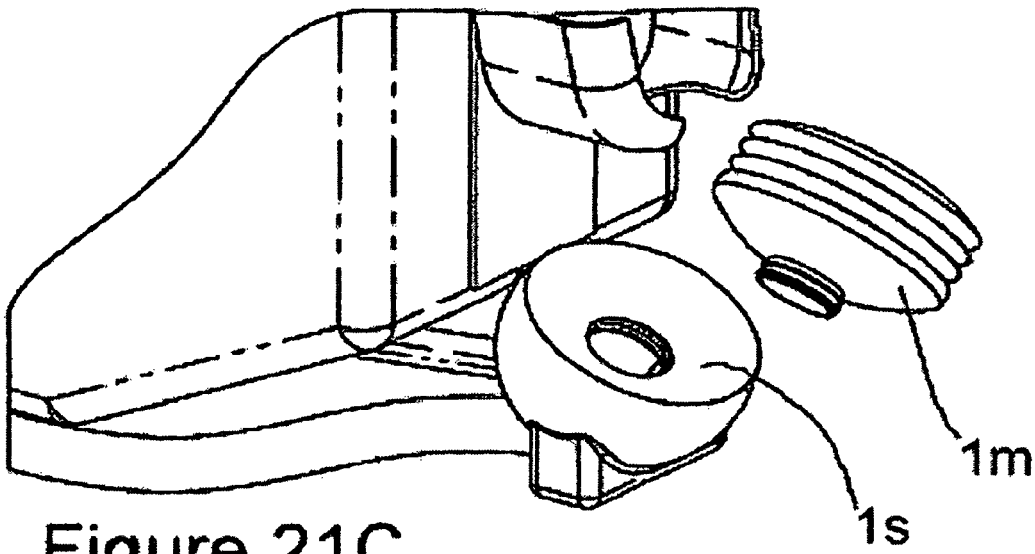

Referring to FIGS. 1 through 21C of the drawings, it will be noted that FIGS. 1 through 6 illustrate a first preferred embodiment of the liquid dispensing system of the present invention, FIGS. 7 through 10 illustrate a first alternative embodiment of the pump used in the first preferred embodiment liquid dispensing system of the present invention, FIGS. 11 through 15 illustrate a dispensing nozzle used in the preferred embodiments of the liquid dispensing system of the present invention, FIGS. 12 through 12F illustrate a first alternative embodiment dispensing nozzle used in the first preferred embodiment of the liquid dispensing system of the present invention, FIG. 12A illustrates a second alternative embodiment dispensing nozzle used in the first preferred embodiment of the liquid dispensing system of the present invention, FIG. 15A illustrates a third alternative embodiment dispensing nozzle used in the first preferred embodiment of the liquid dispensing system of the present invention, FIGS. 16 through 21 illustrate a second preferred embodiment of the liquid dispensing system of the present invention, FIG. 21A illustrates an alternative embodiment dispensing nozzle used in the second preferred embodiment of the liquid dispensing system of the present invention, FIG. 21B illustrates a third preferred embodiment of the liquid dispensing system of the present invention, and FIG. 21C illustrates a first alternative embodiment of the pump used in the second preferred embodiment liquid dispensing system of the present invention.

Reference will now be made to FIGS. 1 through 6, which show a first preferred embodiment of the liquid dispensing system of the present invention, as indicated by general reference numeral 20. The first preferred embodiment liquid dispensing system 20 comprises a liquid container 1 having a top end 1*t* and a bottom end 1*b*. The liquid container 1 also has a first opening 1*a* for liquids to pass therethrough. As can be readily seen in the figures, the first opening 1*a* is disposed adjacent the top end 1*t* of the liquid container 1 and is defined by a threaded portion 23. The liquid container 1, is preferably made from a suitable plastic material, such as Polyethylene™, but can be made of any other suitable material. As can be readily seen in the figures, the liquid container 1 comprises a fuel container, also known as a gasoline container, but can also comprise any other type of liquid container for use in a liquid dispensing system.

A manually operable pump means 15 is operatively connectable in removable and replaceable relation to the liquid container 1. The manually operable pump means 15 is connected, as shown, to the liquid container, so as to be in liquid receiving relation to the first opening 1*a* of the liquid container 1. As can be readily seen in FIGS. 2 through 6, the manually operable pump means 15 comprises a foot operable bellows type pump 15. Other types of pump means could also readily be used.

The pump 15 includes a first opening 19*a* disposed at a barbed inlet end 19, for receiving liquid thereinto from the liquid container 1, and a second opening 18*a*, disposed at a hose end connector 18, for liquid to be dispensed from the pump 15. The removable and replaceable pump 15 is an add-on pump designed to be compatible with the vast majority of current fuel containers presently on the market.

As can be seen in FIG. 1, the liquid container 1 has a container spout 4 secured in place at the first opening 1*a* by means of a container screw cap 3. In order to configure the container 1 for use as the liquid dispensing system 20 according to the present invention, the container screw cap 3 and container spout 4 are removed from the container 1. The pump 15 is connected to the container 1 at the first opening 1*a* using the container's screw cap 3 threadibly engaged on the co-operating threaded portion 23 of the liquid container 1.

As can be best seen in FIGS. 5 and 6, the pump 15 is positioned to contact a substantially horizontal supporting surface, such as the ground, when the liquid container 1 is rotated about a horizontal axis such that the first opening 1*a* is adjacent the horizontal supporting surface. In this orientation, the substantially horizontal supporting surface supports the manually operable pump 15 during pumping, as will be discussed in greater detail subsequently.

A flexible hose 14 is made from a flexible plastic material, and has an attached end 14*a* and a free end 14*b*. The flexible hose 14 is operatively connected at its attached end 14*a* in liquid receiving relation to the manually operable pump 15 at its second opening 18*a*, via the barbed hose end connector 18 on the pump 15. The container spout 4, container 1 shown mounted on the container in FIG. 1 and removed from the container in FIGS. 5 through 6, is threadibly engaged onto the spout coupler 30 of the dispensing nozzle 13, as is best seen in FIGS. 2 through 6, as will be discussed in greater detail subsequently.

A universal coupling ring 22, as shown in place and also additionally separated from the container 1 and pump 15, allows the pump 15 to be connected to container 1. As can be best seen in FIGS. 3 and 4, the barbed inlet end 19 of the pump 15 is connected to flexible hose 21 that is preferably made from a corrosion resistant material. The flexible hose 21 passes though the container screw cap 3, through the universal coupling ring 22 and into the container opening 1*a*. The universal coupling ring 22 has internal threads 42 that are threadibly engaged onto the pump threads 25 thus sandwiching the gasket 20 between the coupling ring 22 and the pump 15 to create an liquid-tight seal. The container screw cap 3 is then threadibly engaged onto the container's threaded portion 23 at the opening 1*a*, thereby tightly securing the coupling ring 22 along with the pump 15 to the container 1.

The first end 14*a* of the flexible hose 14 is connected to the barbed inlet end 19 of the pump 15 and the second end 14*b* of the flexible hose 14 extends down into the container 1 and rests at the lowest point 10 of the container 1 when the container is in the pumping or fuel transferring position, as shown in FIGS. 5 and 6.

The liquid dispensing system 20 further comprises a dispensing nozzle 13 operatively connecting in liquid receiving relation to the free end 14*b* of the flexible hose 14 to receive liquid pumped by the pump 15. The received liquid is dispensed through the dispensing nozzle 13, more specifically through the spout 4 mounted on the dispensing nozzle 13. In the various embodiments of the present invention, the dispensing nozzle 13 includes an interchangeable spout 4 as can be best seen in FIGS. 11 through 15, and as will be discussed in greater detail subsequently with reference to those figures.

The liquid dispensing system has have various check valves at the pump core 54. A first air check valve 57, as best seen in FIG. 4 is incorporated into the universal coupling ring 22. The first air check valve 57 allows air to flow into the container 1, thus enabling the air pressure within the container 1 to equalize as liquid is being pumped out.

A second check valve 56 is a pumping check valve, and is best seen in FIG. 3. The pumping check valve 56 of the pump 15 can be positioned at either end of the flexible hose 21 or in the opening of the barbed inlet end 19. A third check valve 30*c* is incorporated into the spout coupler 30 of the dispensing nozzle 13, as can be seen in FIG. 13.

The pumping check valve 56 regulates the fluid flow so that the fluid will only flow in one direction, from the container 1 into the pump 15. When the pump top 26 is stepped on the pumping check valve 56 will close which prevents liquid in the pump 15 from returning into the container 1. The force of stepping on the pump top 26 will push the fluid into the nozzle hose 14 and through the dispensing nozzle 13. When pressure on the pump top 26 is released the operator's foot is removed the pump bellows 16 will expand to draw in more liquid. As the pump bellows 16 expands to draw in more fluid the third check valve within the spout coupler 30 will close to prevent the liquid from being suctioned out of the dispensing nozzle 13. The closure of the spout coupler 30 check valve will assure the pumping check valve 56 opens to allow fluid from the container 1 to flow into the pump 15.

Reference will now be made to FIGS. 7 through 10, which show a first alternative embodiment of the pump used in the first preferred embodiment liquid dispensing system according to the present invention. The first alternative embodiment pump 27 is similar to the pump 15 used in the first preferred embodiment liquid dispensing system, except that the pump 27 is of a slightly different form. The pump 27 is rectangular in shape, and is a "hinged" bellows design. As can be best seen in FIGS. 8 through 10, this bellows pump 27 has a slightly larger foot engaging surface 29, than does the pump 15 in the first preferred embodiment liquid dispensing system 20. Other suitable types of pumps may also be used in the present invention.

Reference will now be made to FIGS. 11 through 15, which show, in greater detail, the dispensing nozzle 13 according to the present invention. The dispensing nozzle 13 comprises a main body 13*a* having a coupling means in the form of a spout coupler 30. The spout coupler 30 is for receiving spout 4 thereon. The spout 4 is removably mounted on the main body via the coupling means. More specifically, the nozzle screw cap 12 fits over the spout 4 in the same manner as described with reference to the first preferred embodiment of the liquid dispensing system 20, so as to capture the annular flange 4*f*, as best seen in FIG. 3, at the retained end 4*a* of the spout 4. The nozzle screw cap 12 threadibly engages the threads 30*a* of the spout coupler 30, so as to removably secure the spout 4 to the main body 13*a* of the nozzle 13.

The dispensing nozzle 13 also comprises a check valve 13*b* operatively mounted in the main body 13*a*, specifically within the coupling means 30, as can be best seen in FIGS. 13 through 15. The check valve 13*b* acts to preclude rearward flow of the liquid within the dispensing nozzle 13 back into the pump 15 and the liquid container 1. In this manner, when the pump 15 or pump 27, as the case may be, expands, fluid will not be suctioned back into the pump 15 and liquid container 1. Alternatively, the check valve 13*b* can be operatively mounted in the spout, as is shown in FIG. 15A.

The spout 4 is operatively connectable in fluid communication to flexible hose 14 for receiving liquid therefrom, and more specifically is directly connectable in fluid communication to the flexible hose 14, via the spout coupler 30.

As can be best seen in FIGS. 13 through 15, the dispensing nozzle 13 further comprises a nozzle control arm 33 pivotally mounted at a pinched pin connector 32 of the bottom of connecting rod 39. The nozzle control arm 33 is moveable between a lower rest position, as can be best seen in FIGS. 13 and 15, and a raised flow position, as can be best seen in FIG. 14. An angled pinch head 34 disposed on the top of the connecting rod 39 engages the flexible hose 14 so as to pinch it against a first pinched pin 36 and a second pinched pin 37. A spring 31 interposed between the pinch head 34 and a spring stop 40 biases the pinch head 34 against the flexible hose 14.

In order to start the flow with the dispensing nozzle 13 of this invention, as can be best seen in FIG. 14, an operator squeezes the nozzle control arm 33 in an upward direction towards the upper nozzle body 43 which in turn pulls the angled pinch head 34 away from the nozzle hose 14. This motion removes the pinching pressure of the angled pinch head 34 on the nozzle hose 14 and allows the fluid to flow.

In order to stop the flow with the dispensing nozzle 13, as can be best seen in FIG. 15, pressure is released from the nozzle control arm 33, which in turn allows the compressed spring 31 to push the angled pinch head 34 up against the nozzle hose 14 at pinch spot 35. This in turn pinches the hose against the flexible hose pinch spot stops 36 and 37 stopping the fluid flow.

An alternative embodiment of the dispensing nozzle is shown in FIGS. 12A through 12F. The dispensing nozzle 13 has an auto-closure type of spout 58. The auto-closure spout 58 is a safety feature, which prevents spilling by automatically sealing the end of the spout when the auto-closure spout 58 is with drawn from a container, such as a fuel tank 66. The auto-closure spout 58 has a movable sliding sleeve 59 with a pair of gas tank engaging sleeve hooks 61 on it. The movable sliding sleeve 59 of the auto-closure spout 58 has a sleeve sealing end 60. A spout sprue 62 having a sprue sealing end 63 is secured to a spout base 65 and is disposed at the sleeve sealing end 60 of the movable sliding sleeve 59. A sleeve spring 64 biases the movable sliding sleeve 59 to a closed position, as can be best seen in FIG. 12B.

In order to dispense fluid with an auto-closure spout 58, the sleeve sealing end 60 of the auto-closure spout 58 must be placed inside the tank opening 67 so that the sleeve hooks 61 are hooked on to the rim 68 of the tank opening 61. Once in place, the nozzle 13 is pushed downward towards the tank 66. In doing so, the sliding sleeve 59 will be pushed back away from the sprue sealing end 63 opening up the spout so as to allow fluid to flow out. When dispensing of the liquid is finished, the nozzle 13 can be withdrawn from the tank 66. The sleeve spring 64, which was compressed as the sliding sleeve 59 was pushed back, will return the sliding sleeve 59 to its closed position, thus preventing subsequent dispensing of fluid from the auto-closure spout 58, by bringing the sleeve sealing end 60 into contact with the sprue sealing end 63.

As can be readily understood, the auto-closure spout 58 precludes the dispensing of liquid from a liquid container unless the sleeve sealing end 60 of the auto-closure spout 58 is inserted into a container having an appropriately sized mouth.

Figure 15B:
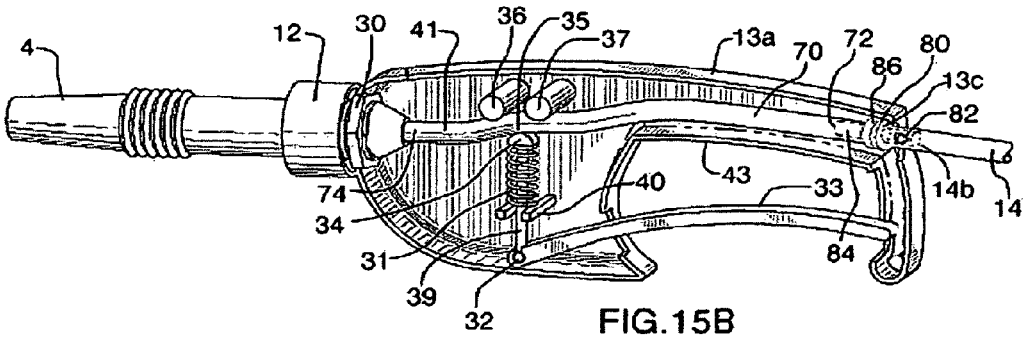
FIG. 15B is a side elevational view of an embodiment of the dispensing nozzle used in the liquid dispensing system of the present invention, specifically showing the dispensing nozzle being removable and replaceable onto the flexible hose.

In a third alternative embodiment, as is shown in FIG. 15B, the spout 4 is operatively connectable in fluid communication to the flexible hose 14, by means of a flexible tube 70 having an inlet 72 and an outlet 74. The flexible tube 70 is disposed within the main body 13*a*. The outlet 74 of the flexible tube 70 is connected in fluid communication to the coupling means 30. The inlet 72 of the flexible tube 20 is connected in fluid communication to the flexible hose 14, so as to receive liquid therefrom, by means of a coupler 80. The coupler 80 has a first reduced portion 82 that extends outwardly from the main body 13*a* of the nozzle 13 through a cooperating aperture 13*c*, and receives the free end 14*b* of the flexible hose 14 thereon, a second reduced portion 84 that receives the inlet 72 of the flexible tubing 70 thereon, and an enlarged central portion 86 that retains the coupler 80 within the main body 13*a* of the dispensing nozzle 13. A fluid check valve 13C is operatively mounted in the housing 13*a*, specifically in the coupler 80.

Reference will now be made to FIGS. 16 through 21, which show a second preferred embodiment of the liquid dispensing system according to the present invention. The second preferred embodiment of the invention is similar to the first preferred embodiment of the invention, except that the second preferred embodiment liquid dispensing system comprises an integrated container 1*i* that consists of a molded container with a molded pump 15*i* integrated into the integrated container 1*i*, as best seen in FIGS. 16 through 19. When the container spout 4 is attached by the container screw cap 3*i*, the integrated container 1*i* can be used to dispense liquid therefrom, by means of pouring, through the integrally molded pump 15*i*. The container spout 4 can be removed and replaced by pump core 54, which will allow the dispensing nozzle 13 assembly to be connected to the pump 15*i* via the flexible hose 14. The container spout 4 previously removed from the container 1*i* can be threadibly engaged onto the spout coupler 30 of the dispensing nozzle 13. In another aspect of the present invention, the liquid dispensing system as shown in FIGS. 16 through 21 comprises a liquid container 1*i* having a primary reservoir 1*p* and a secondary reservoir 1*s*. The liquid container 1*i*, as illustrated, comprises a single integrally formed piece of plastic, and is a gasoline container, but may also be any other sort of suitable container, as will be described in greater detail subsequently.

Figure 19:
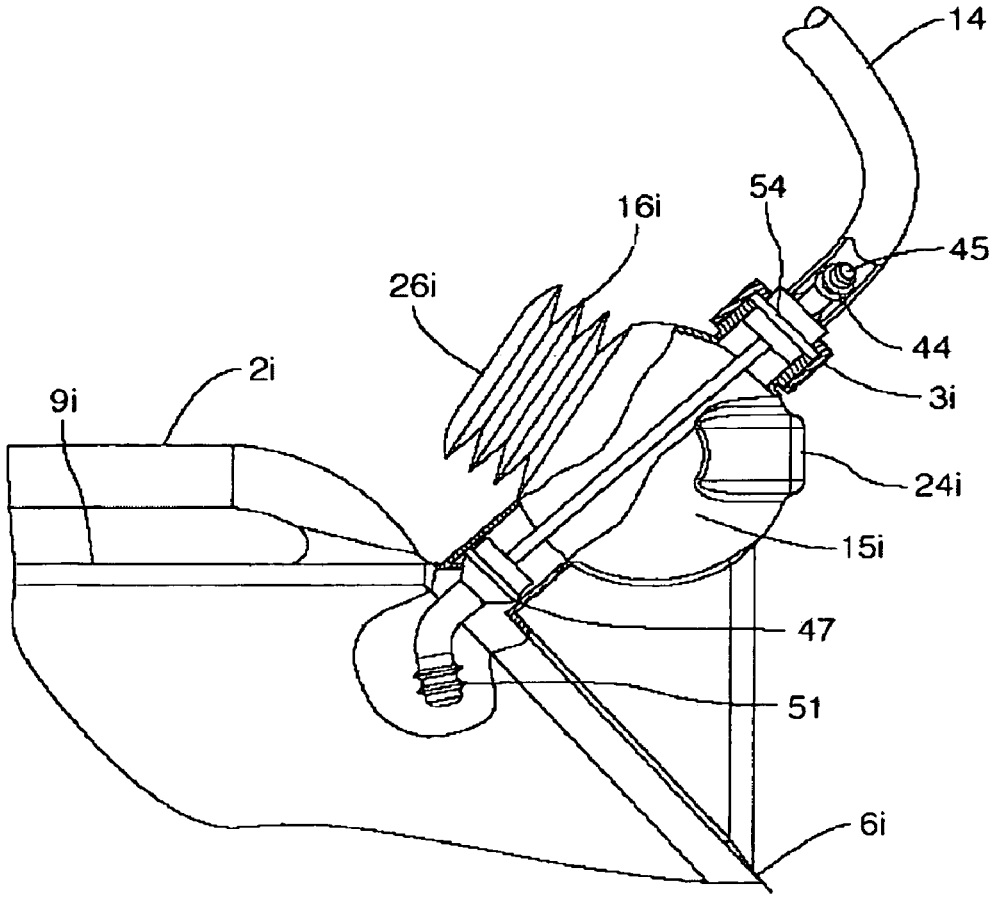
FIG. 19 is a cross-sectional side elevational view of the liquid dispensing system of FIG. 16.

As can be best seen in FIG. 19, a throughpassage 1*t* interconnects the primary reservoir 1*p* and the secondary reservoir 1*s* in fluid communication one with the other. A first opening 1*f* in the secondary reservoir 1*s* is for the ingress of liquid into and the egress of liquid from the liquid container 1*i*. A cap 3*i* and an insertable disk (not specifically shown) is engageable in sealed relation on the secondary reservoir 1*s* at the first opening 1*f*, so as to close off the first opening 1*f*.

The secondary reservoir 1*s* includes a manually manipulable flexible 1*m* portion that acts as a manually operable pump means for causing the egress of liquid from the container 1*i* through the first opening 1*f*. As can be readily seen in the Figures, the manually operable pump means comprises a foot operable bellows type pump 15*i*. Any other suitable type of pump may also be used.

A flexible hose 14*i* is operatively connected in liquid receiving relation to the first opening 1*f* of the secondary reservoir 1*s*, and more specifically, is operatively connected in liquid receiving relation to the second liquid outlet passageway of the pump core.

Figure 17:
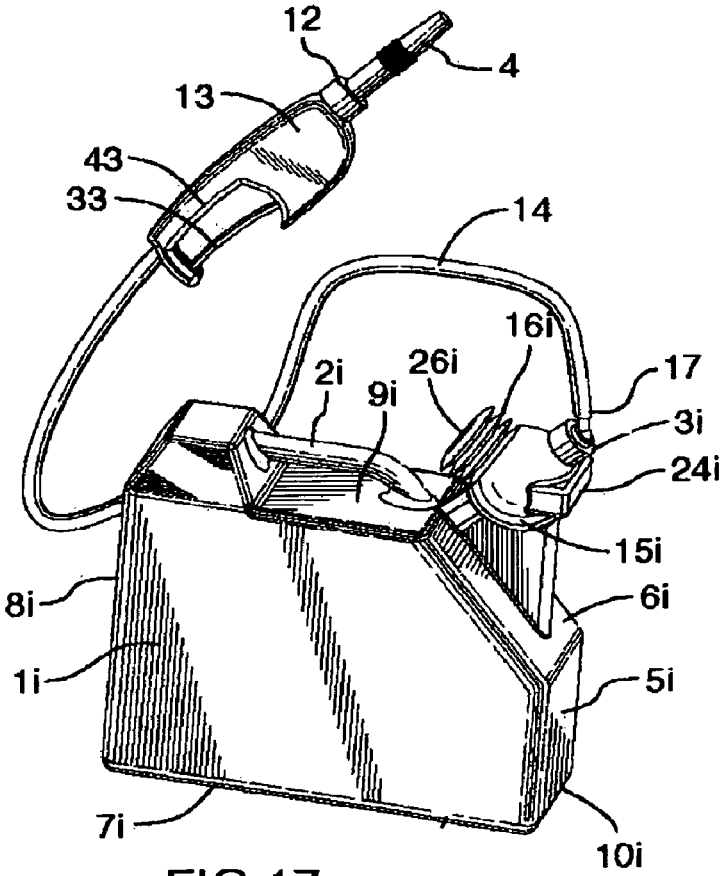
FIG. 17 is a side elevational view of the liquid dispensing system of FIG. 16, with the dispensing spout having been removed and a flexible hose and dispensing nozzle connected in its place.
Figure 18:
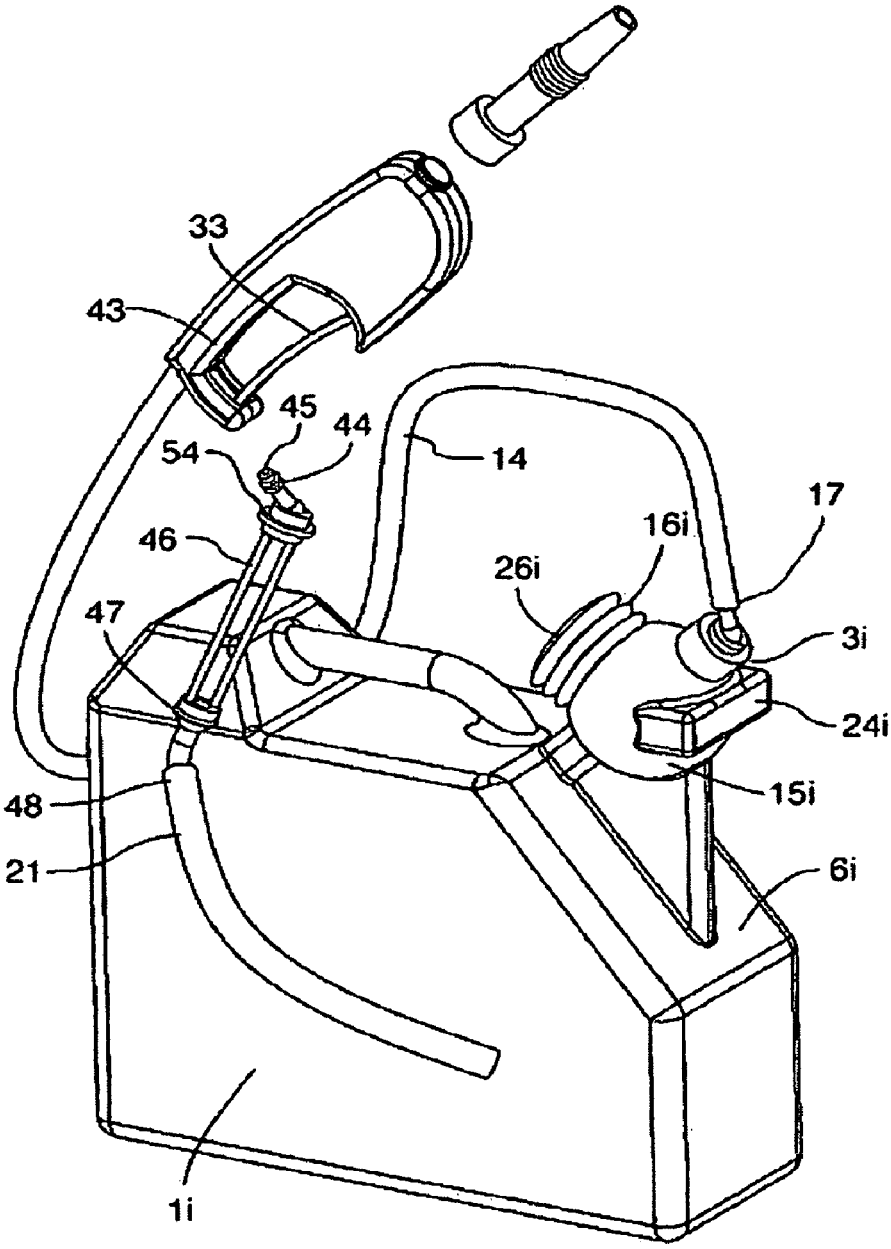
FIG. 18 is an enlarged perspective view of the liquid dispensing system of FIG. 17, additionally showing the pump core outside the pump, for ease of reference.

A dispensing nozzle 13*i* is operatively connected in liquid receiving relation to the flexible hose 14*i* to receive liquid pumped by the pump means 15*i*, and wherein the liquid is dispensed through the dispensing nozzle 13*i*. The dispensing nozzle 13*i* includes an interchangeable spout 4*i*, as can be best seen in FIGS. 16 and 17. In FIG. 16, the spout 4*i* is engaged in sealed relation on the secondary reservoir 1*s* at the first opening 1*f*, so as to permit direct dispensing of liquid from the liquid container 1*i* through the first opening 1*f*. In FIG. 17, the spout 4*i* is mounted directly on the dispensing nozzle 13*i*. Further, the spout may be an auto-closure type spout 58', mounted directly on the dispensing nozzle 13*i*', as shown as an alternative embodiment in FIG. 21A. The auto-closure spout 58' is identical to the auto-closure spout 58 discussed above. As can be readily understood, the auto-closure spout 58' precludes the dispensing of liquid from a liquid container unless the sleeve sealing end 60' of the auto-closure spout 58' is inserted into a container having an appropriately sized mouth.

The second preferred embodiment liquid dispensing system further comprises a pump core 54 having an internal end 54*a* in fluid communication with the primary reservoir 1*p* and an external end 54*b* in fluid communication with the exterior of the liquid container 1*i*. An air inlet passageway 50 extends between the internal end 54*a* and the external end 54*b*. The exterior of the liquid container 1*i* is thereby in air flow communication with the primary reservoir 1*p*. As can be best seen in FIGS. 20 and 21, the pump core 54 further comprises a first liquid outlet passageway 52*a* extending between the internal end 54*a* of the pump core 54 and the secondary reservoir 1*s*. The primary reservoir 1*p* is thereby in fluid communication with the secondary reservoir 1*s*. The pump core 54 further comprises a second liquid outlet passageway 52*b* extending between the secondary reservoir 1*s* and the exterior of the liquid container 1*i*. The secondary reservoir 1*s* is thereby in fluid communication with the exterior of the liquid container 1*i*.

The pump core 54 of the integrated container 1*i* contains the air intake 50, air way tube 46 air check valve 53 and the pumping check valve 52 where the function of these features are the same as that for the add-on pump 15 design described in paragraph 0028. The pump core 54 is located inside the integrated pump 15*i*. As the operator applies pressure in a downward direction on the integrated pump top 26*i* pumping check valve 52 will close and the fluid in the pump 15*i* is pushed into the nozzle hose 14 and through the dispensing nozzle 13. As this is occurring air is drawn into the integrated container 1*i* via the air intake 50, through air way tube 46 past air check valve 53 and into the container 1*i*. The air way tube 46 allows air to by passes the pump and the check valve 53 prevents liquid inside the container 1*i* from flowing out through the air way tube 46. As the operator releases pressure on the integrated pump top 26*i* removes foot the spout coupler 30 check valve will close and the pumping check valve 52 will open to allow the fluid from the container 1*i* to flow into the integrated pump 15*i*. The seal 47 of the pump core 54 seals the pump 15*i* chamber off from the container 1*i* area.

The liquid dispensing system has have various check valves at the pump core 54. A first air check valve 53, as best seen in FIG. 21 is incorporated into the universal coupling ring 22. The first air check valve 53 allows air to flow into the container 1*i*, thus enabling the air pressure within the container 1*i* to equalize as liquid is being pumped out.

A second check valve 52 is a pumping check valve, and is best seen in FIG. 3. A third check valve 30*c* is incorporated into the spout coupler 30 of the dispensing nozzle 13, as can be seen in FIG. 13.

In a first alternative embodiment of the pump used in the second alternative embodiment liquid dispensing system, as can be seen in FIG. 21C, the manually manipulable flexible portion 1*m* is removable and replaceable on the remaining portion of the secondary reservoir 1*s*.

Reference will now be made to FIG. 21B, which shows a third preferred embodiment of the liquid dispensing system of the present invention, as indicated by general reference numeral 320. The liquid dispensing system 320 is functionally similar to and structurally analogous to the second preferred embodiment liquid dispensing system; however, it is structurally somewhat different. The third preferred embodiment liquid dispensing system 320 comprises a bottle suitable for retaining and dispensing lotion or shampoo, or the like. The liquid container 330 has a primary reservoir 331 and a secondary reservoir 332, and comprises a single integrally formed piece of plastic. A throughpassage 334 interconnects the primary reservoir 331 and a secondary reservoir 332 in fluid communication one with the other. A first opening 340 in the secondary reservoir 332 is for the ingress of liquid into and the egress of liquid from the liquid container 330. A cap member 350 is engageable in sealed relation on the secondary reservoir 332 at the first opening 340, so as to close off the first opening 340.

In the various embodiments of the present invention, an operator is able to pump gas from either container 1 or 1*i* into a receiving container in a controlled, convenient, safe and spill-free manner. To dispense the liquid the assembly of the container 1 and 1*i* respectively, pump 15 and 15*i* are rotated forwardly (see FIGS. 5,6 and 22) until the pump leg 24 and 24*i* rests on the ground. To commence pumping liquid, an operator presses down on the pump top 26 and 26*i* with their foot while simultaneously squeezing the nozzle control arm 33 of the nozzle 13 in an upward direction towards the nozzle upper body 43. The nozzle control arm 33 in turn allows liquid to flow through the flexible hose pinch spot 35, through the nozzle spout 4 and into a receiving container.

The various embodiments of the present invention, as discussed above, have many advantages the prior art, as will now be discussed.

One advantage is that this system does not pressurize the container 1 in order to move the fluid. One prior art apparatus, as discussed above, requires the pressurization of the fuel container in order force the fluid through the hose and nozzle. This is a potentially explosive situation and is therefore highly undesirable. The present invention does not utilize pressurization within the containers 1 and 1*i*.

A second advantage is that any mechanical failure of the nozzle will not result in a spill or leak. The dispensing nozzle 13 does not utilize a mechanical valve to regulate the flow such as the competitive products. Mechanical failure is mainly due to parts that wear out. This wearing process can introduce contaminants into the fluid as it is being dispensed. The design of the present invention's nozzle 13 also eliminates potential contamination of the fluid being pumped. The nozzle design is especially appropriate for corrosive and even consumable liquids. Liquid will not come in contact with any metal or mechanism that could potentially deteriorate.

A third advantage of the present invention is that it is easy to clean and sterilize. The present invention can be used in situations such as pumping liquids for human consumption where it is necessary to clean and sterilize the components. For example, the pump 15, flexible hose 14 and the spout 4 can be used to pumping homemade wine into bottles. The nozzle and pump can be separated, cleaned and sterilized. The nozzle is designed to disassemble easily so the components can be cleaned and the flexible hose replaced quickly with a new clean sterile piece of tubing if required.

A fourth advantage of the invention is the spout coupler 30, which allows the user to connect various kinds of spouts presently offered on the market to the nozzle 13 of this invention. There are numerous fuel container manufacturers and each manufacturer has its own unique spout. Typical spouts are just a formed tube used to direct the flow of liquid from the container. Presently, new environmental regulations commonly known as CARB (California Air Regulation Board) compliance require manufacturers of portable fuel containers to provide spouts that offer an auto shut off and an auto closure feature which regulates the flow of liquid from their container. The auto shut off and auto closure feature stops the flow of liquid from the container when the spout is either removed from the receiving container or when the fluid level in the receiving container rises to cover the tip of the spout. These safety features prevent spills caused by over filling and these spouts can be easily connected to the spout coupler 30 of the nozzle 13 of this invention to provide further safety and control of the fluid transferring operation.

As can be understood from the above description and from the accompanying drawings, the present invention provides a liquid dispensing system a liquid dispensing system that can be used to dispense various types of liquids in almost any situation, that does not rely on siphoning, that is easy to use, and that does not rely on maintaining an increased internal air pressure in order to dispense liquid, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the liquid dispensing system of the present invention without departing from the spirit and scope of the accompanying claims.

I claim:

1. A pump apparatus comprising:

a portable container for storing and transferring liquid, said portable container having a first opening for dispensing liquid;

a manually operable foot pump having an inlet opening for receiving liquid from said portable liquid container into the foot pump and an outlet opening for dispensing liquid out of the foot pump, and having a seating surface for engaging a substantially horizontal supporting surface during pumping;

a coupling means for mounting the foot pump onto a liquid container adjacent said opening, such that said liquid container and the seating surface on said manually operable foot pump together form a stable base engageable on said substantially horizontal supporting surface, and wherein during pumping said liquid container and said seating surface of said manually operable foot pump are together supported by said substantially horizontal supporting surface; and, a flexible delivery tube means having a flexible delivery tube with an inlet end and an outlet end, the delivery tube at its inlet end being mountable to the manually operable foot pump to receive liquid from the manually operable foot pump as liquid is being transferred from a liquid container to permit transfer of the liquid through flexible delivery tube to the outlet end for dispensing; and, wherein said container has a top end and a bottom end, and said opening in said container is disposed adjacent said top end, and wherein, in use, said liquid container is rotated about a horizontal axis such that said seating surface engages said substantially horizontal supporting surface and said first opening is adjacent said substantially horizontal supporting surface.

2. A pump apparatus as claimed in claim 1, further comprising a check valve means having a check valve to ensure that liquid cannot flow backwardly through said manually operable foot pump in the direction from the outlet opening to the inlet opening during pumping of said manually operable foot pump.

3. A pump apparatus as claimed in claim 1, further comprising a dispensing nozzle operatively connectable to said flexible delivery tube at its outlet end.

4. A pump apparatus as claimed in claim 1, wherein said manually operable foot pump comprises a bellows pump.

5. A pump apparatus as claimed in claim 1, further comprising a check valve means having a check valve to ensure that liquid cannot flow backwardly through the pump chamber in the direction from the outlet opening to through the inlet opening during pumping of the pump.

6. A pump apparatus as claimed in claim 2, wherein the check valve means further comprises a check valve to permit atmospheric air to be delivered into the liquid chamber of the container in exchange for liquid pumped by the pump.

7. A pump apparatus as claimed in claim 1, wherein said liquid container comprises a fuel container.

8. A pump apparatus as claimed in claim 1, wherein said outlet is in said manually operable pump means.

9. A pump apparatus as claimed in claim 1, wherein said outlet is in said coupling means.

* * * * *